US007499042B2

(12) United States Patent
Shirasaki et al.

(10) Patent No.: US 7,499,042 B2
(45) Date of Patent: Mar. 3, 2009

(54) DISPLAY DEVICE, DATA DRIVING CIRCUIT, AND DISPLAY PANEL DRIVING METHOD

(75) Inventors: Tomoyuki Shirasaki, Higashiyamato (JP); Kazuhito Sato, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 631 days.

(21) Appl. No.: 11/035,269

(22) Filed: Jan. 12, 2005

(65) Prior Publication Data

US 2005/0157581 A1 Jul. 21, 2005

(30) Foreign Application Priority Data

Jan. 16, 2004 (JP) ..... 2004-009146

(51) Int. Cl.
*G09G 5/00* (2006.01)

(52) U.S. Cl. ..... 345/211; 345/82; 345/83; 345/76; 345/77

(58) Field of Classification Search ..... 345/211, 345/82–83, 76–77
See application file for complete search history.

(56) References Cited

U.S. PATENT DOCUMENTS

| | | | |
|---|---|---|---|
| 5,680,149 | A | 10/1997 | Koyama et al. |
| 6,023,259 | A | 2/2000 | Howard et al. |
| 6,091,382 | A | 7/2000 | Shioya et al. |
| 6,166,714 | A | 12/2000 | Kishimoto |
| 6,229,506 | B1 | 5/2001 | Dawson et al. |
| 6,373,454 | B1 | 4/2002 | Knapp et al. |
| 6,377,235 | B1 | 4/2002 | Murade et al. |
| 6,522,315 | B2 | 2/2003 | Ozawa et al. |
| 6,577,302 | B2 | 6/2003 | Hunter et al. |
| 6,650,060 | B2 | 11/2003 | Okuda |
| 6,661,180 | B2 | 12/2003 | Koyama |
| 6,667,580 | B2 * | 12/2003 | Kim et al. ..... 315/169.3 |

(Continued)

FOREIGN PATENT DOCUMENTS

EP 10146 501 A1 10/2001

(Continued)

OTHER PUBLICATIONS

Japanese Office Action dated Jun. 24, 2008, issued in counterpart Japanese application JP 2004-009146.

(Continued)

*Primary Examiner*—Richard Hjerpe
*Assistant Examiner*—Leonid Shapiro
(74) *Attorney, Agent, or Firm*—Frishauf, Holtz, Goodman & Chick, P.C.

(57) ABSTRACT

A display device includes a plurality of selection scan lines, a plurality of current lines, a selection scan driver which sequentially selects the plurality of selection scan lines in each selection period, a data driving circuit which applies a reset voltage to the plurality of current lines in the selection period and supplies a designating current having a current value corresponding to an image signal to the plurality of current lines after applying the reset voltage, and a plurality of pixel circuits which are connected to the plurality of selection scan lines and the plurality of current lines, and supply a driving current having a current value corresponding to the current value of the designating current which flows through the plurality of current lines.

11 Claims, 11 Drawing Sheets

U.S. PATENT DOCUMENTS

| | | | | |
|---|---|---|---|---|
| 6,734,636 | B2 | 5/2004 | Sanford et al. | |
| 6,744,414 | B2 | 6/2004 | Lee et al. | |
| 6,750,833 | B2 | 6/2004 | Kasai | |
| 6,788,003 | B2 | 9/2004 | Inukai et al. | |
| 6,859,193 | B1 | 2/2005 | Yumoto | |
| 6,900,784 | B2 | 5/2005 | Tsuchida | |
| 6,943,759 | B2 | 9/2005 | Tam | |
| 6,947,019 | B2 * | 9/2005 | Sato et al. | 345/82 |
| 2001/0017618 | A1 | 8/2001 | Azami | |
| 2001/0035863 | A1 | 11/2001 | Kimura | |
| 2001/0052606 | A1 | 12/2001 | Sempel et al. | |
| 2002/0014852 | A1 | 2/2002 | Bae | |
| 2002/0075208 | A1 | 6/2002 | Bae et al. | |
| 2002/0135309 | A1 | 9/2002 | Okuda | |
| 2002/0163514 | A1 | 11/2002 | Nagai et al. | |
| 2002/0195968 | A1 | 12/2002 | Sanford et al. | |
| 2003/0020335 | A1 | 1/2003 | Komiya | |
| 2003/0098708 | A1 | 5/2003 | Matsueda | |
| 2004/0036664 | A1 | 2/2004 | Miyazawa | |
| 2004/0113873 | A1 | 6/2004 | Shirasaki | |
| 2004/0165003 | A1 | 8/2004 | Shirasaki | |
| 2004/0183791 | A1 | 9/2004 | Yoshida et al. | |
| 2004/0246241 | A1 | 12/2004 | Sato et al. | |
| 2004/0256617 | A1 | 12/2004 | Yamada et al. | |
| 2005/0140610 | A1 | 6/2005 | Smith et al. | |
| 2005/0219168 | A1 | 10/2005 | Shirasaki et al. | |
| 2006/0119552 | A1 | 6/2006 | Yumoto | |
| 2006/0214890 | A1 | 9/2006 | Morishige et al. | |

FOREIGN PATENT DOCUMENTS

| | | | |
|---|---|---|---|
| EP | 1 170 718 | A1 | 1/2002 |
| EP | 1 372 136 | A1 | 12/2003 |
| EP | 1 443 483 | A2 | 8/2004 |
| JP | 1-123292 | A | 5/1989 |
| JP | 11-143429 | A | 5/1999 |
| JP | 2000-221942 | A | 8/2000 |
| JP | 2002-149125 | A | 5/2002 |
| JP | 2003-066908 | A | 3/2003 |
| JP | 2003-076327 | A | 3/2003 |
| JP | 2003-195810 | A | 7/2003 |
| JP | 2004-021219 | A | 1/2004 |
| WO | 99/65011 | A2 | 12/1999 |
| WO | WO 01/06484 | A1 | 1/2001 |
| WO | 01/20591 | A1 | 3/2001 |
| WO | WO 01/75852 | A1 | 10/2001 |
| WO | WO 02/39420 | A1 | 5/2002 |
| WO | WO 03/058328 | A1 | 7/2003 |
| WO | WO 2004/001714 | A1 | 12/2003 |

OTHER PUBLICATIONS

Japanese Office Action dated Oct. 9, 2007 (and English translation thereof) which was issued in related U.S. Appl. No. 10/489,381.

Japanese Office Action dated Apr. 30, 2008, issued in counterpart Japanese application JP 2004-099535 of related U.S. Appl. No. 11/093,828.

* cited by examiner

DISPLAY DEVICE, DATA DRIVING CIRCUIT, AND DISPLAY PANEL DRIVING METHOD

CROSS-REFERENCE TO RELATED APPLICATIONS

This application is based upon and claims the benefit of priority from prior Japanese Patent Application No. 2004-009146, filed Jan. 16, 2004, the entire contents of which are incorporated herein by reference.

BACKGROUND OF THE INVENTION

1. Field of the Invention

The present invention relates to a display panel driving method of driving a display panel including a light-emitting element for each pixel, a data driving circuit for driving the display panel, and a display device including the display panel, the data driving circuit, and a selection scan driver.

2. Description of the Related Art

Generally, liquid crystal displays are classified into active matrix driving type liquid crystal displays and simple matrix driving type liquid crystal displays. The active matrix driving type liquid crystal displays display images having contrast and resolution higher than those displayed by the simple matrix driving type liquid crystal displays. In the active matrix driving type liquid crystal display, a liquid crystal element which also functions as a capacitor, and a transistor which functions as a pixel switching element are formed for each pixel. In the active matrix driving system, when a voltage at a level representing luminance is applied to a current line by a data driver while a scan line is selected by a scan driver serving as a shift register, this voltage is applied to the liquid crystal element via the transistor. Even when the transistor is turned off in a period after the selection of the scan line is complete and before the scan line is selected again, the liquid crystal element functions as a capacitor, so the voltage level is held in this period. As described above, the light transmittance of the liquid crystal element is refreshed while the scan line is selected, and light from a backlight is transmitted through the liquid crystal element having the refreshed light transmittance. In this manner, the liquid crystal display expresses a tone.

Displays using organic EL (ElecctroLuminescent) elements as self-light-emitting elements require no such a backlight as used in the liquid crystal displays, and hence are optimum for flat display devices. In addition, the viewing angle is not limited unlike in the liquid crystal display. Therefore, these organic EL displays are increasingly expected to be put into practical use as next-generation display devices.

From the viewpoints of high luminance, high contrast, and high resolution, active matrix driving type organic EL displays are developed similarly to the liquid crystal displays. For example, in the conventional active matrix driving type organic EL display described in Jpn. Pat. Appln. KOKAI Publication No. 2000-221942, a pixel circuit (referred to as an organic EL element driving circuit in patent reference 1) is formed for each pixel. This pixel circuit includes an organic EL element, driving TFT, first switching element, switching TFT, and the like. When a control line is selected, a current source driver applies a voltage as luminance data to the gate of the driving TFT. Consequently, the driving TFT is turned on, and a driving current having a current value corresponding to the level of the gate voltage flows from a power supply line to the driving TFT via the organic EL element, so the organic EL element emits light at luminance corresponding to the current value of the electric current. When the selection of the control line is complete, the gate voltage of the driving TFT is held by the first switching element, so the emission of the organic EL element is also held. When a blanking signal is input to the gate of the switching TFT after that, the gate voltage of the driving TFT decreases to turn it off, and the organic EL element is also turned off to complete one frame period.

Generally, the channel resistance of a transistor changes in accordance with a change in ambient temperature, or changes when the transistor is used for a long time. As a consequence, the gate threshold voltage changes with time, or differs from one transistor to another. Therefore, in the conventional voltage-controlled, active matrix driving type organic EL display in which the luminance and tone are controlled by the signal voltage, it is difficult to uniquely designate the current value of an electric current which flows through the organic EL element by the level of the gate voltage of the driving TFT, even if the current value of the electric current which flows through the organic EL element is changed by changing the level of the gate voltage of the driving TFT by using the signal voltage from the current line. That is, even when the gate voltage having the same level is applied to the driving TFTs of a plurality of pixels, the luminance of the organic EL element changes from one pixel to another. This produces variations in luminance on the display screen. Also, since the driving TFT deteriorates with time, the same gate voltage as the initial gate voltage cannot generate a driving current having the same current value as the initial current value. This also varies the luminance of the organic EL elements.

BRIEF SUMMARY OF THE INVENTION

It is, therefore, an object of the present invention to provide a display device, data driving circuit, and display panel driving method capable of displaying high-quality images.

A display device according to an aspect of the present invention comprises, a plurality of selection scan lines;

a plurality of current lines;

a selection scan driver which sequentially selects the plurality of selection scan lines in each selection period;

a data driving circuit which applies a reset voltage to the plurality of current lines in a first part of the selection period, and supplies a designating current having a current value corresponding to an image signal to the plurality of current lines in a second part of the selection period after applying the reset voltage in the selection period; and a plurality of pixel circuits which are connected to the plurality of selection scan lines and the plurality of current lines, and supply a driving current having a current value corresponding to the current value of the designating current which flows through the plurality of current lines.

A display device according to another aspect of the present invention comprises, a plurality of selection scan lines;

a plurality of current lines;

a plurality of light-emitting elements which are arranged at intersections of the plurality of selection scan lines and the plurality of current lines, and emit light at luminance corresponding to a current value of a driving current;

a selection scan driver which sequentially select the plurality of selection scan lines in each selection period;

a data driving circuit which applies a reset voltage to the plurality of current lines in a first part of the selection period, and supplies a designating current having a current value corresponding to an image signal to the plurality of current lines in a second part of the selection period after applying the reset voltage in the selection period; and a plurality of pixel circuits which are connected to the plurality of selection scan lines and the plurality of current lines, and electrically connect the plurality of current lines and the plurality of light-emitting elements to each other in the selection period.

A data driving circuit according to still another aspect of the present invention comprises, a plurality of light-emitting elements connected to a plurality of selection scan lines and a plurality of current lines, a selection scan driver which sequentially selects the plurality of selection scan lines in each selection period, and a plurality of pixel circuits connected to the plurality of light-emitting elements, wherein a reset voltage is applied to the plurality of current lines in a first part of the selection period, and a designating current having a current value corresponding to an image signal is supplied to the plurality of current lines in a second part of the selection period after the first part of the selection period.

A display panel driving method according to still another aspect of the present invention comprises, a selection step of sequentially selecting a plurality of selection scan lines of a display panel comprising a plurality of pixel circuits connected to the plurality of selection scan lines and a plurality of current lines, and a plurality of light-emitting elements which are arranged at intersections of the plurality of selection scan lines and the plurality of current lines, each of the light-emitting elements emits light at luminance corresponding to a current value of a current flowing the current line; and a reset step of applying a reset voltage to the plurality of current lines in an initial part of a period in which each of the plurality of selection scan lines is selected.

In the present invention, it is possible not only to discharge the parasitic capacitance of a current line by applying a reset voltage in a selection period, but also to discharge the parasitic capacitance of a pixel circuit or the parasitic capacitance of a light-emitting element.

DETAILED DESCRIPTION OF THE INVENTION

Figure 1:
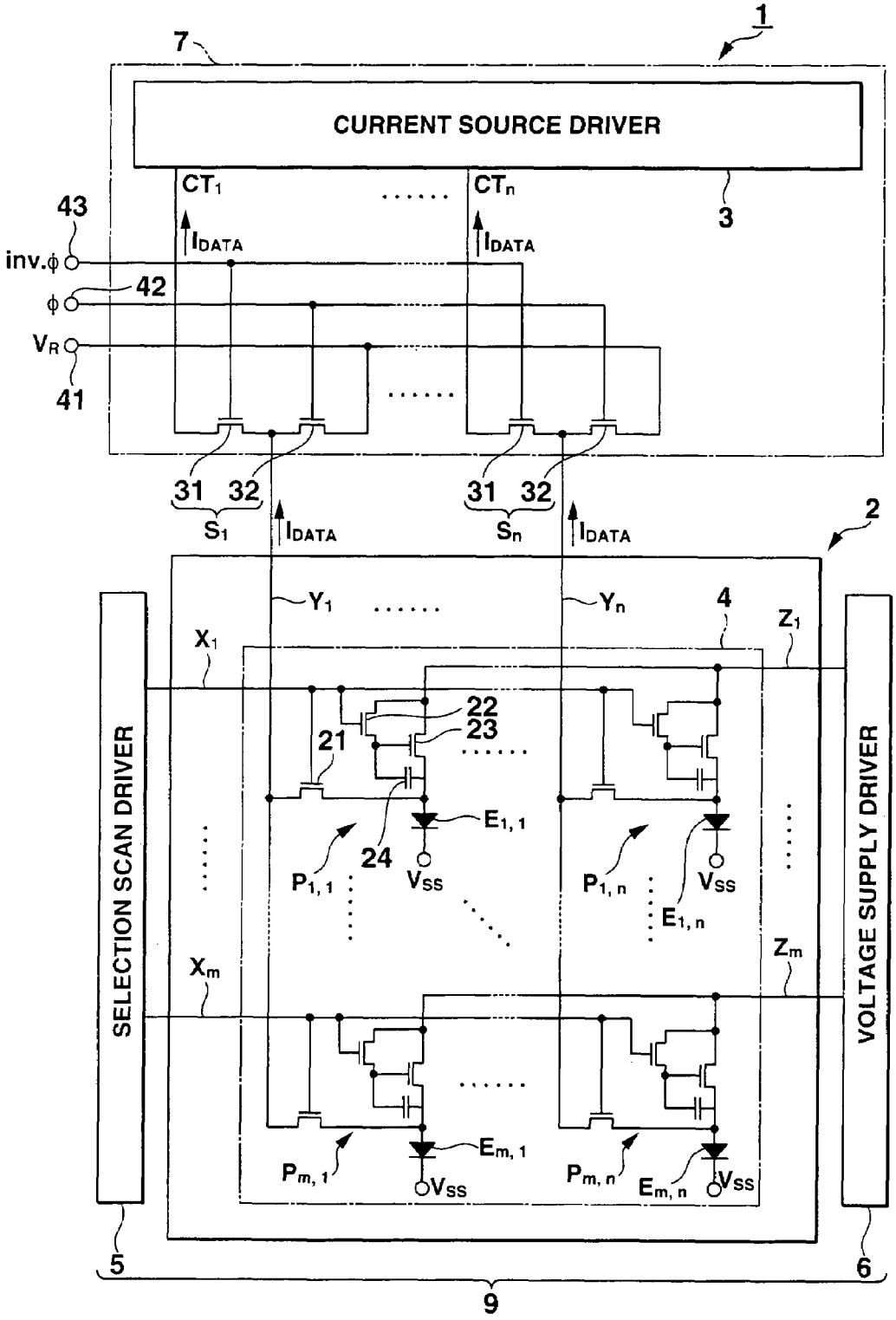
FIG. 1 is a block diagram of an organic electroluminescent display 1 according to the first embodiment of the present invention.

Best modes for carrying out the invention will be described below with reference to the accompanying drawings. Various technically preferred limitations are imposed on the following embodiments in order to, carry out the present invention. However, the scope of the invention is not limited to the embodiments and examples shown in the drawing.

First Embodiment

FIG. 1 is a block diagram showing an organic electroluminescent display 1 according to the first embodiment to which the organic electroluminescent display of the present invention is applied. As shown in FIG. 1, the organic electroluminescent display 1 includes, as its basic configuration, an organic electroluminescent display panel 2 having m selection scan lines $X_1$ to $X_m$, m voltage supply lines $Z_1$ to $Z_m$, n current lines $Y_1$ to $Y_n$, and pixels $P_{1,1}$ to $P_{m,n}$. The display 1 further includes, a scan driving circuit 9 for linearly scanning the organic electroluminescent display panel 2 in the longitudinal direction, and a data driving circuit 7 for supplying a tone designating current $I_{DATA}$ to the current lines $Y_1$ to $Y_n$ in cooperation with the scan driving circuit 9. Here, each of m and n is a natural number of 2 or more.

The scan driving circuit 9 has a selection scan driver 5 for sequentially selecting the selection scan lines $X_1$ to $X_m$, and a voltage supply driver 6 for sequentially selecting the voltage supply lines $Z_1$ to $Z_m$ in synchronism with the sequential selection of the selection scan lines $X_1$ to $X_m$ by the selection scan driver 5. The data driving circuit 7 has a current source driver 3. The driver 3 includes n current terminals $CT_1$ to $CT_n$ and allows the tone designating current $I_{DATA}$ to flow through the current terminals $CT_1$ to $CT_n$, and switches $S_1$ to $S_n$ interposed between the current terminals $CT_1$ to $CT_n$ and current lines $Y_1$ to $Y_n$.

The organic electroluminescent display panel 2 has a structure in which a display unit 4 for practically displaying images is formed on a transparent substrate. The selection scan driver 5, voltage supply driver 6, current source driver 3, and switches $S_1$ to $S_n$ are arranged around the display unit 4. Portions or the whole of the selection scan driver 5, the voltage supply driver 6, the current source driver 3, and at least one of the switches $S_1$ to $S_n$ can be integrated with the organic electroluminescent display panel 2 as they are formed on the transparent substrate, or can be formed around the organic electroluminescent display panel 2 as they are formed into a chip different from the organic electroluminescent display panel 2. Note that the display unit 4 may also be formed on a flexible sheet such as a resin sheet, instead of the transparent substrate.

In the display unit 4, the (m×n) pixels $P_{1,1}$ to $P_{m,n}$ are formed in a matrix on the transparent substrate such that m pixels are arranged in the longitudinal direction, i.e., the column direction, and n pixels are arranged in the lateral direction, i.e., the row direction. A pixel which is an ith pixel (i.e., a pixel in the ith row) from above and a jth pixel (i.e., a pixel in the jth column) from left is a pixel $P_{i,j}$. Note that i is a given natural number from 1 to m, and j is a given natural number from 1 to n.

Accordingly, in the display unit 4, the m selection scan lines $X_1$ to $X_m$ running in the row direction are formed parallel to each other on the transparent substrate. The m voltage supply lines $Z_1$ to $Z_m$ running in the row direction are formed parallel to each other on the transparent substrate in one-to-one correspondence with the selection scan lines $X_1$ to $X_m$. The voltage supply line $Z_k$ ($1 \leqq k \leqq m-1$) is positioned between the selection scan lines $X_k$ and $X_{k+1}$, and the selection scan line $X_m$ is positioned between the voltage supply lines $Z_{m-1}$ and $Z_m$. Also, the n current lines $Y_1$ to $Y_n$ running in the column direction are formed parallel to each other on the upper side of the transparent substrate. The selection scan lines $X_1$ to $X_m$, voltage supply lines $Z_1$ to $Z_m$, and current lines $Y_1$ to $Y_n$ are insulated from each other as they are separated by insulating films or the like interposed between them. The n pixels $P_{i,1}$ to $P_{i,n}$ arranged along the row direction are connected to the selection scan line $X_i$ and voltage supply line $Z_i$ in the ith row. The m pixels $P_{1,j}$ to $P_{m,j}$ arranged along the column direction are connected to the current line $Y_j$ in the jth column. The pixel $P_{i,j}$ is positioned at the intersection of the selection scan line $X_i$ and current line $Y_j$. The selection scan lines $X_1$ to $X_m$ are connected to output terminals of the selection scan driver 5. The voltage supply lines $Z_1$ to $Z_m$ are connected to output terminals of the voltage supply driver 6.

Figure 2:
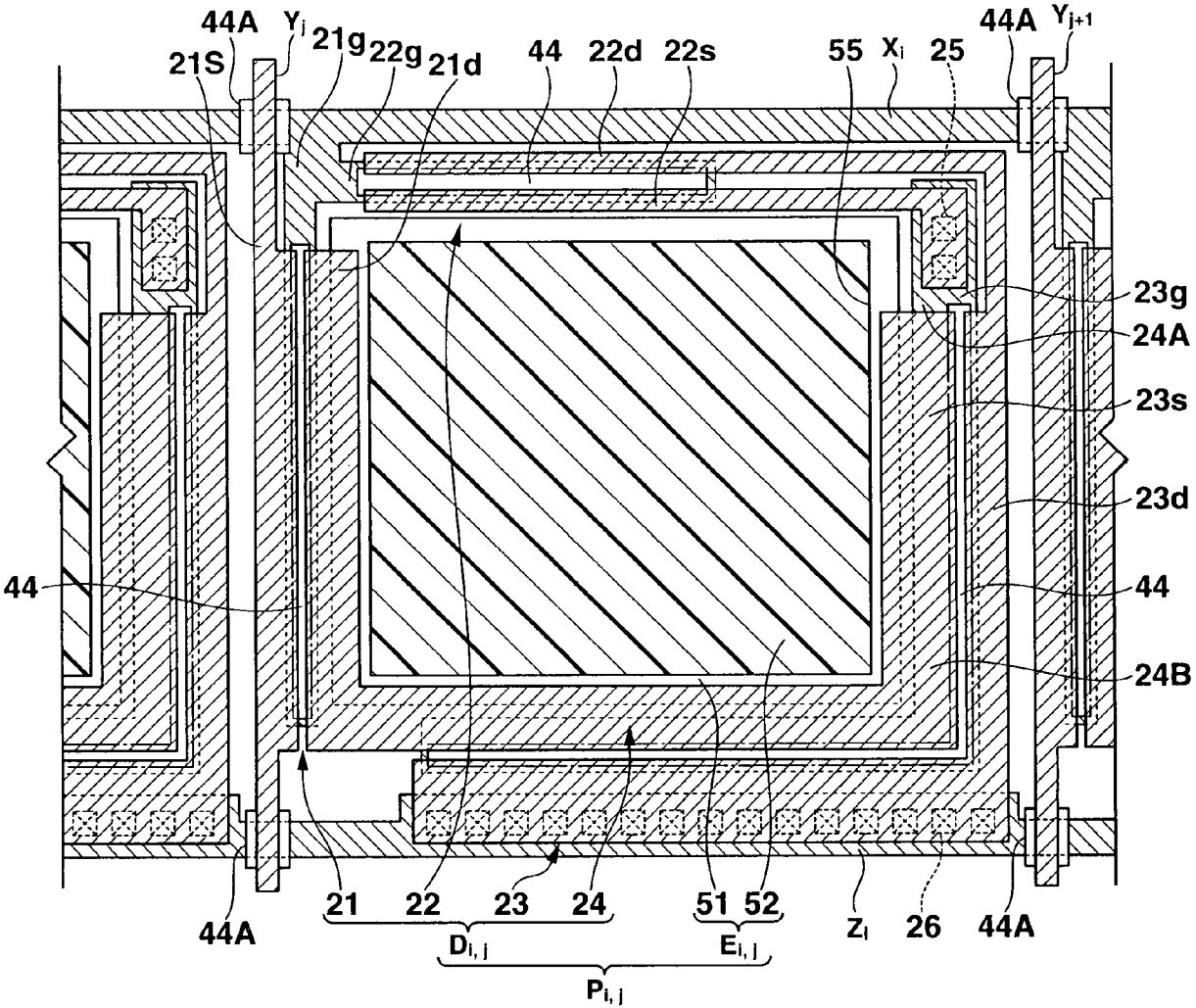
FIG. 2 is a plan view of a pixel $P_{i,j}$ of the organic electroluminescent display 1.
Figure 3:
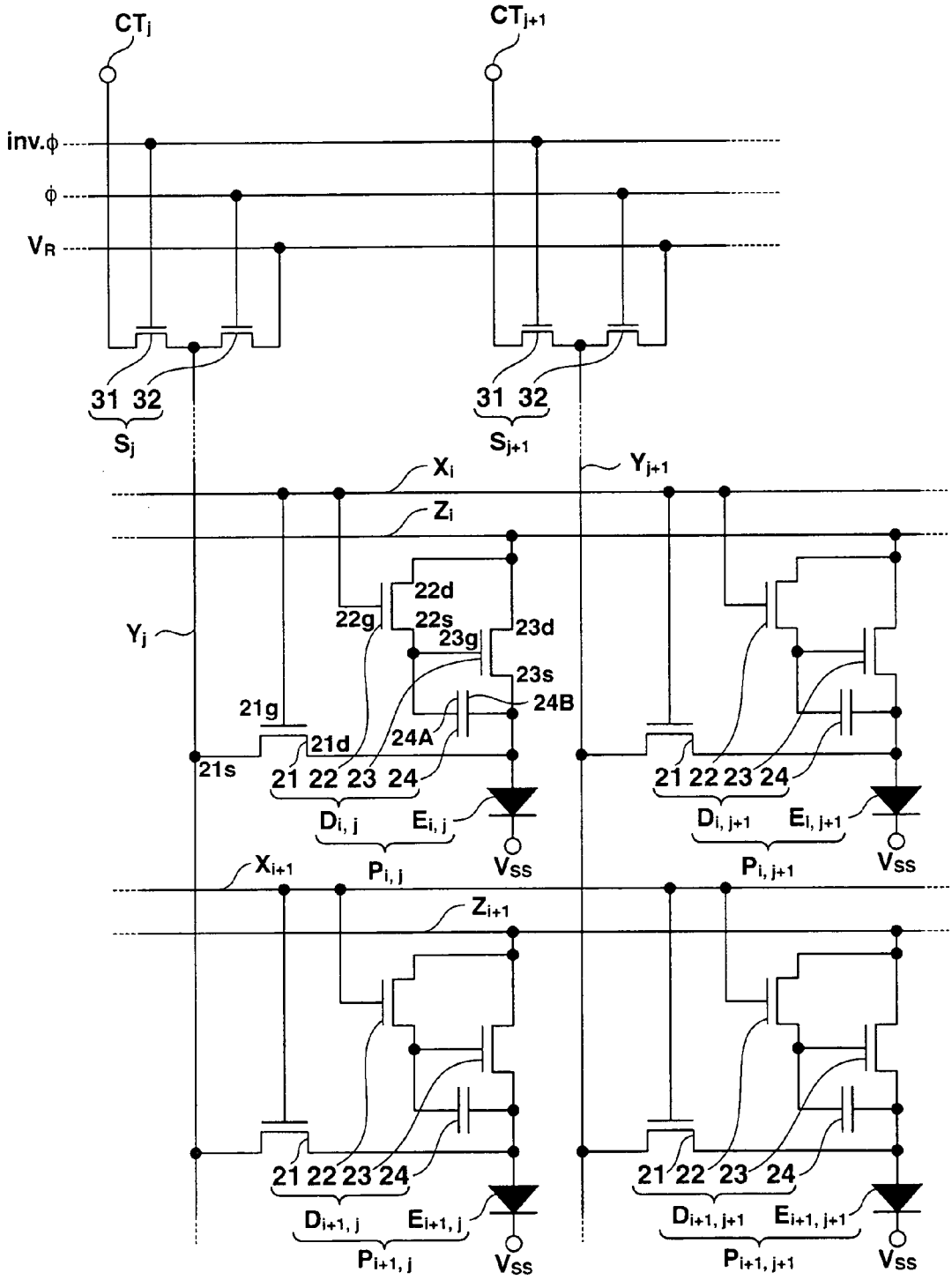
FIG. 3 is an equivalent circuit diagram of four adjacent pixels $P_{i,j}$, $P_{i+1,j}$, $P_{i,j+1}$, and $P_{i+1,j+1}$ of the organic electroluminescent display 1.

The pixels $P_{1,1}$ to $P_{m,n}$ will be explained below with reference to FIGS. 2 and 3. FIG. 2 is a plan view showing the pixel $P_{i,j}$. FIG. 3 is an equivalent circuit diagram showing, e.g., four adjacent pixels $P_{i,j}$, $P_{i+1,j}$, $P_{i,j+1}$, and $P_{i+1,j+1}$. FIG. 2 principally shows the electrodes in the pixel $P_{i,j}$ to allow better understanding.

The pixel $P_{i,j}$ includes an organic electroluminescent element $E_{i,j}$ as a self-light-emitting element which emits light in accordance with the value of an electric current, and a pixel circuit $D_{i,j}$ which is formed around the organic electroluminescent element $E_{i,j}$, and drives it. Note that the organic electroluminescent element will be referred to as an organic EL element hereinafter.

The organic EL element $E_{i,j}$ has a stacked structure in which a pixel electrode 51, organic EL layer 52, and common electrode are stacked in this order on the transparent substrate. The pixel electrode 51 functions as an anode. The organic EL layer 52 functions as a light-emitting layer in a broad sense, i.e., transports holes and electrons injected by an electric field, recombines the transported holes and electrons, and emits light by excitons produced by the recombination. The common electrode functions as a cathode. Although the common electrode is formed to cover the entire pixel, the it is not shown in FIG. 2 so that the pixel electrode 51, organic EL layer 52, pixel circuit $D_{i,j}$ and the like are readily seen.

The pixel electrode 51 is patterned for each of the pixels $P_{1,1}$ to $P_{m,n}$ in each of regions surrounded by the current lines $Y_1$ to $Y_n$, selection scan lines $X_1$ to $X_m$, and voltage supply lines $Z_1$ to $Z_m$.

The pixel electrode 51 is a transparent electrode. That is, the pixel electrode 51 has both conductivity and transparency to visible light. Also, the pixel electrode 51 preferably has a relatively high work function, and efficiently injects holes into the organic EL layer 52. Examples of main components of the pixel electrode 51 are tin-doped indium oxide (ITO), zinc-doped indium oxide, indium oxide ($In_2O_3$), tin oxide ($SnO_2$), zinc oxide (ZnO), and cadmium-tin oxide (CTO).

The organic EL layer 52 is formed on each pixel electrode 51. The organic EL layer 52 is also patterned for each of the pixels $P_{1,1}$ to $P_{m,n}$. The organic EL layer 52 contains a light-emitting material (phosphor) as an organic compound. This light-emitting material can be either a high- or low-molecular material. In particular, the organic EL layer 52 has a two-layered structure in which a hole transporting layer and a light-emitting layer in a narrow sense are stacked in this order on the pixel electrode 51. The hole transporting layer is made of a PEDOT (polythiophene) as a conductive polymer, and PSS (polystyrene sulfonic acid) as a dopant. The light-emitting layer in a narrow sense is made of a polyfluorene-based, light-emitting material. Note that the organic EL layer 52 may also have a three-layered structure having a hole transporting layer, a light-emitting layer in a narrow sense, and an electron transporting layer stacked in this order on the pixel electrode 51, or a single-layered structure having only a light-emitting layer in a narrow sense, instead of the two-layered structure. An electron or hole injecting layer may also be interposed between appropriate layers in any of these layered structures, and some other stacked structure may also be used.

The organic EL display panel 2 can display full-color images or multicolor images. The organic EL layer 52 of each of the pixels $P_{1,1}$ to $P_{m,n}$ is a light-emitting layer in a broad sense which has a function of emitting red, green, or blue light. That is, the organic EL layers 52 which emit red light, green light, and blue light are regularly arranged, and the display unit 4 displays images in a color tone obtained by properly synthesizing these colors.

The organic EL layer 52 is desirably made of an organic compound which is neutral with respect of electrons. This allows balanced injection and transportation of holes and electrons in the organic EL layer 52. One or both of an electron transporting substance and hole transporting substance may also be properly mixed in the light-emitting layer in a narrow sense. It is also possible to cause a charge transporting layer which is an electron or hole transporting layer to function as a recombination region which recombines electrons and holes, and to emit light by mixing a phosphor in this charge transporting layer.

The common electrode formed on the organic EL layers 52 is formed for all the pixels $P_{1,1}$ to $P_{m,n}$. Note that instead of this common electrode formed for all the pixels $P_{1,1}$ to $P_{m,n}$, it is also possible to use a plurality of divided electrodes, e.g., a plurality of stripe electrodes divided for individual columns, or a plurality of stripe electrodes divided for individual rows. Generally, the organic EL layers 52 which emit different colors are made of different materials, and the light emission characteristics with respect to the current density depend upon the material. To adjust the luminance balance between different emission colors, therefore, pixels which emit the same color can be connected together in order to set the value of an electric current for each emission color of the organic EL layer 52. That is, assuming that a first-emission-color pixel emits a predetermined luminance at a relatively low current density, and a second-emission-color pixel requires a high current density in order to emit the same luminance as the first-emission-color pixel, the emission color balance can be adjusted by supplying, to the second-emission-color pixel, a tone electric current which is larger than that of the first-emission-color pixel.

The common electrode is electrically insulated from the selection scan lines $X_1$ to $X_m$, current lines $Y_1$ to $Y_n$, and voltage supply lines $Z_1$ to $Z_m$. The common electrode is made of a material having a low work function. For example, the common electrode is made of indium, magnesium, calcium, lithium, barium, a rare earth metal, or an alloy containing at least one of these elements. Also, the common electrode can have a stacked structure in which layers of the various materials described above are stacked, or a stacked structure in which a metal layer is deposited in addition to these layers of the various materials. Practical examples are a stacked structure including a low-work-function, high-purity barium layer formed in the interface in contact with the organic EL layer 52, and an aluminum layer which covers this barium layer, and a stacked structure having a lithium layer as a lower layer and an aluminum layer as an upper layer. When the pixel electrode 51 is a transparent electrode and light emitted from the organic EL layer 52 is output from the transparent substrate through the pixel electrode 51, the common electrode preferably has light-shielding properties with respect to the light emitted from the organic EL layer 52, and more preferably has a high reflectance to the light emitted from the organic EL layer 52.

When a forward bias voltage (by which the voltage of the pixel electrode 51 becomes higher than that of the common electrode) is applied between the pixel electrode 51 and common electrode in the organic EL element $E_{i,j}$ having the stacked structure as described above, holes are injected into the organic EL layer 52 from the pixel electrode 51, and electrons are injected into the organic EL layer 52 from the common electrode. The organic EL layer 52 transports these holes and electrons, and recombines them to produce excitons. Since these excitons excite the organic EL layer 52, the organic EL layer 52 emits light.

The luminance of the organic EL element $E_{i,j}$ depends on the current value of an electric current which flows through the organic EL element $E_{i,j}$; the larger the electric current which flows through the organic EL element $E_{i,j}$, the higher the luminance of the organic EL element $E_{i,j}$. That is, if deterioration of the organic EL element $E_{i,j}$ is not taken into consideration, the luminance of the organic EL element $E_{i,j}$ is uniquely determined when the current value of the electric current which flows through the organic EL element $E_{i,j}$ is determined.

Each of the pixel circuits $D_{1,1}$ to $D_{m,n}$ includes three thin-film transistors (to be simply referred to as transistors hereinafter) 21, 22, and 23, and a capacitor 24.

Each of the transistors 21, 22, and 23 is an N-channel MOS field-effect transistor having a gate, drain, source, semiconductor layer 44, impurity-dosed semiconductor layer, and gate insulating film. Each transistor is particularly an a-Si transistor in which the semiconductor layer 44 (channel region) is made of amorphous silicon. However, each transistor may also be a p-Si transistor in which the semiconductor layer 44 is made of polysilicon. In either case, the transistors 21, 22, and 23 are N-channel field-effect transistors, and can have either an inverted stagger structure or a coplanar structure.

Also, the transistors 21, 22, and 23 can be simultaneously formed in the same process. In this case, the compositions of the gates, drains, sources, semiconductor layers 44, impurity-dosed semiconductor layers, and gate insulating films of the transistors 21, 22, and 23 are the same, and the shapes, sizes, dimensions, channel widths, and channel lengths of the transistors 21, 22, and 23 are different from each other in accordance with the functions of the transistors 21, 22, and 23. Note that the transistors 21, 22, and 23 will be referred to as a first transistor 21, second transistor 22, and driving transistor 23, respectively, hereinafter.

The capacitor 24 has a first electrode 24A connected to a gate 23*g* of the driving transistor 23, a second electrode 24B connected to a source 23*s* of the transistor 23, and a gate insulating film (dielectric film) interposed between these two electrodes. The capacitor 24 has a function of storing electric charges between the gate 23*g* and source 23*s* of the driving transistor 23.

In the second transistor 22 of each of the pixel circuits $D_{i,1}$ to $D_{i,n}$ in the ith row, a gate 22*g* is connected to the selection scan line $X_i$ in the ith row, and a drain 22*d* is connected to the voltage supply line $Z_i$ in the ith row. In the driving transistor 23 of each of the pixel circuits $D_{i,1}$ to $D_{i,n}$ in the ith row, a drain 23*d* is connected to the voltage supply line $Z_i$ in the ith row through a contact hole 26. In the first transistor 21 of each of the pixel circuits $D_{i,1}$ to $D_{i,n}$ in the ith row, a gate 21*g* is connected to the selection scan line $X_i$ in the ith row. In the first transistor 21 of each of the pixel circuits $D_{1,j}$ to $D_{m,j}$ in the jth column, a source 21*s* is connected to the current line $Y_j$ in the jth column.

In each of the pixels $P_{1,1}$ to $P_{m,n}$, a source 22*s* of the second transistor 22 is connected to the gate 23*g* of the driving transistor 23 through a contact hole 25, and to one electrode of the capacitor 24. The source 23*s* of the driving transistor 23 is connected to the other electrode of the capacitor 24, and to a drain 21*d* of the first transistor 21. The source 23*s* of the driving transistor 23, the other electrode of the capacitor 24, and the drain 21*d* of the first transistor 21 are connected to the pixel electrode 51.

The voltage of the common electrode of the organic EL elements $E_{1,1}$, to $E_{m,n}$ is held at a predetermined reference voltage $V_{SS}$. In this embodiment, the reference voltage $V_{SS}$ is set at 0 [V] by grounding the common electrode of the organic EL elements $E_{1,1}$, to $E_{m,n}$.

The pixel electrodes 51 are divided by patterning for individual pixels surrounded by regions surrounded by the current lines $Y_1$ to $Y_n$, selection scan lines $X_1$ to $X_m$, and voltage supply lines $Z_1$ to $Z_m$. In addition, the edges of each pixel electrode 51 are covered with an interlayer dielectric film made of silicon nitride or silicon oxide which covers the three transistors 21, 22, and 23 of each pixel circuit, and the upper surface of the center of the pixel electrode 51 is exposed through a contact hole 55 formed in this interlayer dielectric film. Note that the interlayer dielectric film can have a first layer made of silicon nitride or silicon oxide, and a second layer formed on the first layer by using an insulating film made of, e.g., polyimide.

Between the selection scan line $X_i$ and current line $Y_j$, and between the voltage supply line $Z_i$ and current line $Y_j$, a protective film 44A is formed by patterning the same film as the semiconductor layer 44 of each of the transistors 21 to 23, in addition to the gate insulating film. Note that in order to protect the surface, which serves as a channel, of the semiconductor layer 44 of each of the transistors 21, 22, and 23 from being roughened by an etchant used in patterning, a blocking insulating layer made of silicon nitride or the like may also be formed except for the two end portions of the semiconductor layer 44. In this case, a protective film may be formed by patterning the same film as the blocking insulating layer between the selection scan line $X_i$ and current line $Y_j$, and between the voltage supply line $Z_i$ and current line $Y_j$. This protective film and the protective film 44A may also be overlapped.

Figure 4:
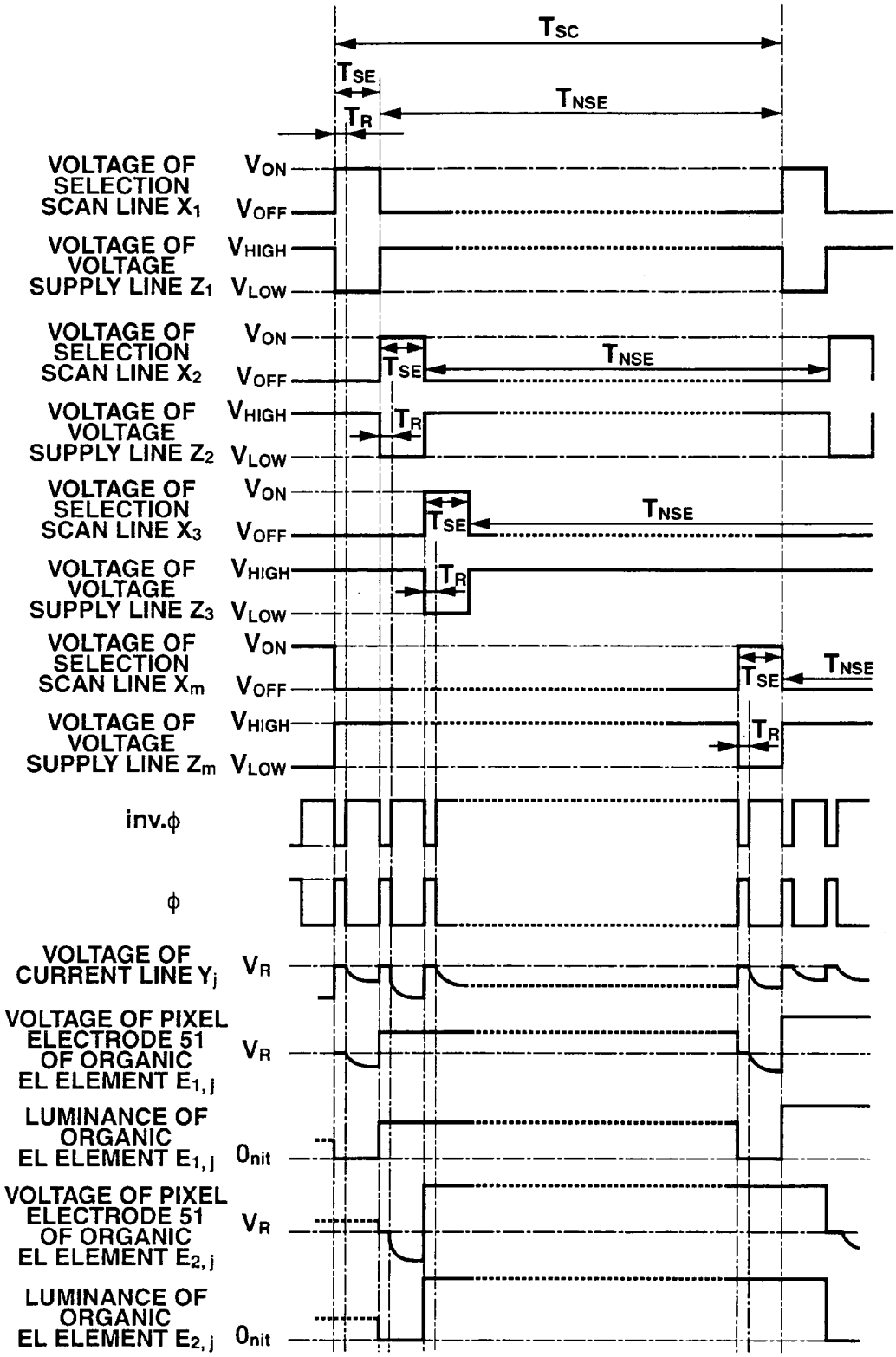
FIG. 4 is a timing chart showing the levels of signals in the organic electroluminescent display 1.

The selection scan driver 5, voltage supply driver 6, switches $S_1$ to $S_n$, and current source driver 3 will be described below with reference to FIG. 4. FIG. 4 is a timing chart showing, from above, the voltage of the selection scan line $X_1$, the voltage of the voltage supply line $Z_1$, the voltage of the selection scan line $X_2$, the voltage of the voltage supply line $Z_2$, the voltage of the selection scan line $X_3$, the voltage of the voltage supply line $Z_3$, the voltage of the selection scan line $X_m$, the voltage of the voltage supply line $Z_m$, the level (voltage value) of a switching signal inv.Φ, the level of a switching signal Φ, the voltage of the current line $Y_j$, the voltage of the pixel electrode 51 of the organic EL element $E_{1,j}$, the luminance of the organic EL element $E_{1,j}$, the voltage of the pixel electrode 51 of the organic EL element $E_{2,j}$, and the luminance of the organic EL element $E_{2,j}$. Referring to FIG. 4, the abscissa represents the common time.

The selection scan driver 5 is a so-called shift register, and has an arrangement in which m flip-flop circuits and the like are connected in series. That is, the selection scan driver 5 sequentially selects the selection scan lines $X_1$ to $X_m$ by sequentially outputting selection signals in order from the selection scan line $X_1$ to the selection scan line $X_m$ (the selection scan line $X_m$ is followed by the selection scan line $X_1$), thereby sequentially selecting the first and second transistors 21 and 22 in these rows connected to the selection scan lines $X_1$ to $X_m$.

More specifically, as shown in FIG. 4, the selection scan driver 5 individually applies, to the selection scan lines $X_1$ to $X_m$, a high-level (ON-level) ON voltage $V_{ON}$ (much higher than the reference voltage $V_{SS}$) as a selection signal or a low-level OFF voltage $V_{OFF}$ (equal to or lower than the reference voltage $V_{SS}$) as a non-selection signal, thereby sequentially selecting the selection scan lines $X_1$ to $X_m$.

That is, when the selection scan driver 5 applies the ON voltage $V_{ON}$ to the selection scan line $X_i$, the selection scan line $X_i$ in the ith row is selected. A period in which the selection scan driver 5 applies the ON voltage $V_{ON}$ to the selection scan line $X_i$ in the ith row and thereby selects the selection scan line $X_i$ in the ith row is called a selection period $T_{SE}$ of the ith row. Note that while applying the ON voltage $V_{ON}$ to the selection scan line $X_i$, the selection scan driver 5 applies the OFF voltage $V_{OFF}$ to the other selection scan lines $X_1$ to $X_m$ (except for the selection scan line $X_i$). Accordingly, the selection periods $T_{SE}$ of the selection scan lines $X_1$ to $X_m$ do not overlap each other.

When the selection scan driver 5 applies the ON voltage $V_{ON}$ to the selection scan line $X_i$ in the ith row, the first and second transistors 21 and 22 are turned on in each of the pixel circuits $D_{i,1}$ to $D_{i,n}$ connected to the selection scan line $X_i$ in the ith row. Since the first transistors 21 are turned on, an electric current which flows through the current lines $Y_1$ to $Y_n$ can flow through the pixel circuits $D_{i,1}$ to $D_{i,n}$.

After the selection period $T_{SE}$ in which the selection scan line $X_i$ in the ith row is selected, the selection scan driver 5 applies the OFF voltage $V_{OFF}$ to the selection scan line $X_i$ to cancel the selection of the selection scan line $X_i$. As a consequence, in each of the pixel circuits $D_{i,1}$ to $D_{i,n}$ connected to the selection scan line $X_i$ in the ith row, the first and second transistors 21 and 22 are turned off. Since the first transistors 21 are turned off, the electric current which flows through the current lines $Y_1$ to $Y_n$ cannot flow through the pixel circuits $D_{i,1}$ to $D_{i,n}$ any longer. Note that a period in which the selection scan driver 5 applies the OFF voltage $V_{OFF}$ to the selection scan line $X_i$ in the ith row and thereby keeps the selection scan line $X_i$ in the ith row unselected is called a non-selection period $T_{NSE}$ of the ith row. In this case, a period represented by $T_{SE}+T_{NSE}=T_{SC}$, i.e., a period from the start time of the selection period $T_{SE}$ of the selection scan line $X_i$ in the ith row to the start time of the next selection period $T_{SE}$ of the selection scan line $X_i$ in the ith row, is one frame period of the ith row.

The voltage supply driver 6 is a so-called shift register, and has an arrangement in which m flip-flop circuits are connected in series. That is, in synchronism with the selection scan driver 5, the voltage supply driver 6 sequentially selects the voltage supply lines $Z_1$ to $Z_m$ by sequentially outputting selection signals in order from the voltage supply line $Z_1$ to the voltage supply line $Z_m$ (the voltage supply line $Z_m$ is followed by the voltage supply line $Z_1$), thereby sequentially selecting the driving transistors 23 in these rows connected to the voltage supply lines $Z_1$ to $Z_m$.

More specifically, as shown in FIG. 4, the voltage supply driver 6 individually supplies, to the voltage supply lines $Z_1$ to $Z_m$, a low-level tone designating current reference voltage $V_{LOW}$ (which is equal to or lower than the reference voltage $V_{SS}$) as a selection signal or a high-level driving current reference voltage $V_{HIGH}$ (which is higher than both the reference voltage $V_{SS}$ and tone designating current reference voltage $V_{LOW}$) as a non-selection signal, thereby sequentially selecting the voltage supply lines $Z_1$ to $Z_m$.

That is, in the selection period $T_{SE}$ in which the selection scan line $X_i$ in the ith row is selected, the voltage supply driver 6 applies the tone designating current reference voltage $V_{LOW}$ to the voltage supply line $Z_i$ in the ith row, thereby selecting the voltage supply line $Z_i$ in the ith row. While applying the tone designating current reference voltage $V_{LOW}$ to the voltage supply line $Z_i$, the voltage supply driver 6 applies the driving current reference voltage $V_{HIGH}$ to the other voltage supply lines $Z_1$ to $Z_m$ (except for the voltage supply line $Z_i$).

On the other hand, in the non-selection period $T_{NSE}$ in which the selection scan line $X_i$ in the ith row is not selected, the voltage supply driver 6 applies the driving current reference voltage $V_{HIGH}$ to the voltage supply line $Z_i$ to cancel the selection of the voltage supply line $Z_i$ in the ith row. Since the driving current reference voltage $V_{HIGH}$ is higher than the reference voltage $V_{SS}$, an electric current flows from the voltage supply line $Z_i$ to the organic EL element $E_{i,j}$ if the driving transistor 23 is ON and the transistor 21 is OFF.

Figure 5:
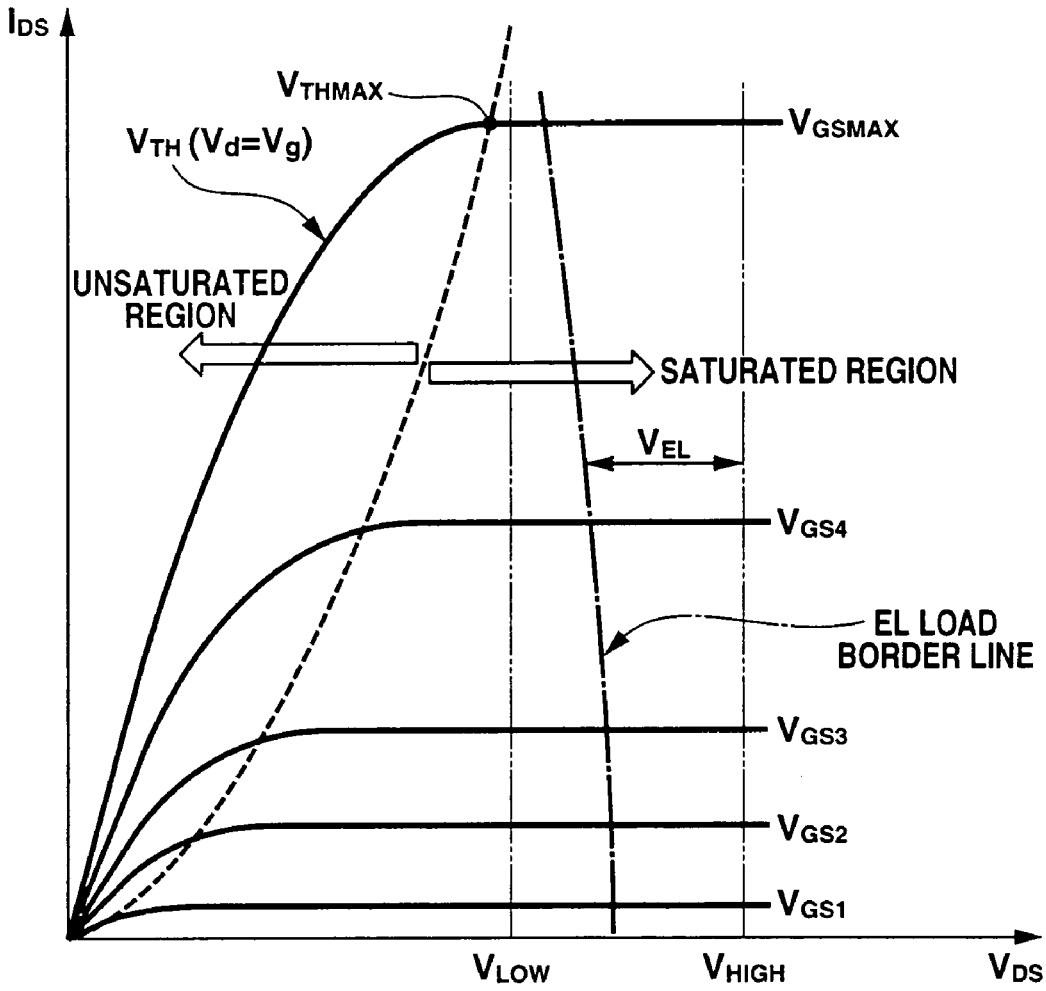
FIG. 5 is a graph showing the current-voltage characteristics of an N-channel field-effect transistor.

The tone designating current reference voltage $V_{LOW}$ applied by the voltage supply driver 6 is equal to or lower than the reference voltage $V_{SS}$. Therefore, even when the driving transistor 23 of each of the pixels $P_{1,1}$ to $P_{m,n}$ is turned on in the selection period $T_{SE}$, a zero voltage or reverse bias voltage is applied between the anode and cathode of each of the organic EL elements $E_{1,1}$ to $E_{m,n}$. Accordingly, no electric current flows through the organic EL elements $E_{1,1}$ to $E_{m,n}$ in the selection period $T_{SE}$, so the organic EL elements $E_{1,1}$ to $E_{m,n}$ do not emit light. On the other hand, the driving current reference voltage $V_{HIGH}$ applied by the voltage supply driver 6 is higher than the reference voltage $V_{SS}$. As shown in FIG. 5, the driving current reference voltage $V_{HIGH}$ is so set that a source-to-drain voltage $V_{DS}$ of the driving transistor 23 is in a saturated region. Accordingly, when the driving transistors 23 are ON in the non-selection period $T_{NSE}$, a forward bias voltage is applied to the organic EL elements $E_{1,1}$, to $E_{m,n}$. In the non-selection period $T_{NSE}$, therefore, an electric current flows through the organic EL elements $E_{1,1}$ to $E_{m,n}$, and the organic EL elements $E_{1,1}$ to $E_{m,n}$ emit light.

The driving current reference voltage $V_{HIGH}$ will be explained below. FIG. 5 is a graph showing the current-voltage characteristics of the N-channel field-effect transistor. Referring to FIG. 5, the abscissa indicates the divided voltage of the driving transistor and the divided voltage of the organic EL element connected in series to the driving transistor, and the ordinate indicates the current value of an electric current in the drain-to-source path. In an unsaturated region (a region where source-to-drain voltage $V_{DS}$<drain saturated threshold voltage $V_{TH}$: the drain saturated threshold voltage $V_{TH}$ is a function of a gate-to-source voltage $V_{GS}$, and is uniquely determined by the gate-to-source voltage $V_{GS}$ if the gate-to-source voltage $V_{GS}$ is determined) shown in FIG. 5, if the gate-to-source voltage $V_{GS}$ is constant, a drain-to-source current $I_{DS}$ increases as the source-to-drain voltage $V_{DS}$ increases. In addition, in a saturated region (in which source-to-drain voltage $V_{DS}\geqq$drain saturated threshold voltage $V_{TH}$) shown in FIG. 5, if the gate-to-source voltage $V_{GS}$ is constant, the drain-to-source current $I_{DS}$ is substantially constant even when the source-to-drain voltage $V_{DS}$ increases.

Also, in FIG. 5, gate-to-source voltages $V_{GS1}$ to $V_{GSMAX}$ have the relationship 0 [V]<$V_{GS1}$<$V_{GS2}$<$V_{GS3}$<$V_{GS4}$<$V_{GSMAX}$. That is, as is apparent from FIG. 5, if the source-to-drain voltage $V_{DS}$ is constant, the drain-to-source current $I_{DS}$ increases in both the unsaturated and saturated regions as the gate-to-source voltage $V_{GS}$ increases. In addition, the drain saturated threshold voltage $V_{TH}$ increases as the gate-to-source voltage $V_{GS}$ increases.

From the foregoing, in the unsaturated region, the drain-to-source current $I_{DS}$ changes if the source-to-drain voltage $V_{DS}$ slightly changes while the gate-to-source voltage $V_{GS}$ is constant. In the saturated region, however, the drain-to-source current $I_{DS}$ is uniquely determined by the gate-to-source voltage $V_{GS}$.

The drain-to-source current $I_{DS}$ when the maximum gate-to-source voltage $V_{GSMAX}$ is applied to the driving transistor 23 is set to be an electric current which flows between the common electrode and the pixel electrode 51 of the organic EL element $E_{i,j}$ which emits light at the maximum luminance.

Also, the following equation is met so that the driving transistor 23 maintains the saturated region in the selection period $T_{SE}$ even when the gate-to-source voltage $V_{GS}$ of the driving transistor 23 is the maximum voltage $V_{GSMAX}$ in the non-selection period.

$$V_{LOW}=V_{HIGH}-V_E-V_{SS}\geqq V_{THMAX}$$

where $V_E$ is the anode-to-cathode voltage which the organic EL element $E_{i,j}$ requires to emit light at the maximum luminance in the light emission life period, and $V_{THMAX}$ is the source-to-drain saturated voltage level of the driving transistor 23 when the voltage is $V_{GSMAX}$. The driving current reference voltage $V_{HIGH}$ is set to satisfy the above equation. Accordingly, even when the source-to-drain voltage $V_{DS}$ of the driving transistor 23 decreases by the divided voltage of the organic EL element $E_{i,j}$ connected in series to the driving transistor 23, the source-to-drain voltage $V_{DS}$ always falls within the range of the saturated state, so the drain-to-source current $I_{DS}$ is uniquely determined by the gate-to-source voltage $V_{GS}$.

As shown in FIGS. 1 and 3, the current lines $Y_1$ to $Y_n$ are connected to the current terminals $CT_1$ to $CT_n$ of the current source driver 3 via the switches $S_1$ to $S_n$. An 8-bit digital tone image signal is input to the current source driver 3. This digital tone image signal input to the current source driver 3 is converted into an analog signal by an internal D/A converter of the current source driver 3. The current source driver 3 generates, at the current terminals $CT_1$ to $CT_n$, a tone designating current $I_{DATA}$ having a current value corresponding to the converted analog signal. As shown in FIG. 4, the current source driver 3 controls the current value of the tone designating current $I_{DATA}$ at the current terminals $CT_1$ to $CT_n$ in accordance with the image signal for each selection period $T_{SE}$ of each row, and holds the current value of the tone designating current $I_{DATA}$ constant in a period from the end of each reset period $T_R$ to the end of the corresponding selection period $T_{SE}$. The current source driver 3 supplies the tone designating current $I_{DATA}$ from the current lines $Y_1$ to $Y_n$ to the current terminals $CT_1$ to $CT_n$ via the switches $S_1$ to $S_n$. As shown in FIGS. 1 and 3, the switches $S_1$ to $S_n$ are connected to the current lines $Y_1$ to $Y_n$, and the current terminals $CT_1$ to $CT_n$ of the current source driver 3 are connected to the switches $S_1$ to $S_n$. In addition, the switches $S_1$ to $S_n$ are connected to a reset input terminal 41, and a reset voltage $V_R$ is applied to the switches $S_1$ to $S_n$ via the reset input terminal 41. The switches $S_1$ to $S_n$ are also connected to a switching signal input terminal 42, and a switching signal Φ is input to the switches $S_1$ to $S_n$ via the switching signal input terminal 42. Furthermore, the switches $S_1$ to $S_n$ are connected to a switching signal input terminal 43, and a switching signal inv.Φ obtained by inverting the switching signal Φ is input to the switches $S_1$ to $S_n$ via the switching signal input terminal 43. The reset voltage $V_R$ is constant and has the same level (voltage value) as the tone designating current reference voltage $V_{LOW}$. More specifically, the reset voltage $V_R$ is set at 0 [V] by grounding the reset input terminal 41. Especially when the reset voltage $V_R$ of the ith row is made equal to the voltage of the voltage supply line $Z_i$ in the ith row in the selection period $T_{SE}$, the voltages of the electrodes 24A and 24B of the capacitor 24 become equal to each other. Consequently, the capacitor 24 is discharged, so the gate-to-source voltage of the driving transistor 23 is set at 0V.

The switch $S_j$ (which is interposed between the current line $Y_j$ in the jth column and the current terminal $CT_j$ in the jth column) switches the state in which the current source driver 3 supplies the tone designating current $I_{DATA}$ to the current line $Y_j$, and the state in which the reset voltage $V_R$ is applied to the current line $Y_j$. That is, as shown in FIG. 4, if the switching signal Φ is at high level and the switching signal inv.Φ is at low level, the switch $S_j$ shuts off the electric current of the current terminal $CT_j$, and applies the reset voltage $V_R$ to the current line $Y_j$, the drain 21*d* of the first transistor 21, the electrode 24B of the capacitor 24, the source 23*s* of the driving transistor 23, and the pixel electrode 51 of the organic EL element $E_{x,j}$ ($1\leqq x\leqq m$), thereby discharging the electric charge stored in these components in the preceding selection period $T_{SE}$. On the other hand, if the switching signal Φ is at low level and the switching signal inv.Φ is at high level, the switch $S_j$ allows the electric current of the current terminal $CT_j$ to flow through the current line $Y_j$, and shuts down the application of the reset voltage $V_R$ to the current line $Y_j$.

The cycle of the switching signals Φ and inv.Φ will be explained below. As shown in FIG. 4, the cycle of the switching signals Φ and inv.Φ is the same as the selection period $T_{SE}$. That is, when the selection scan driver 5 starts applying the ON voltage $V_{ON}$ to one of the selection scan lines $X_1$ to $X_m$ (i.e., when the selection period $T_{SE}$ of each row starts), the switching signal Φ changes from high level to low level, and the switching signal inv.Φ changes from low level to high level. While the selection scan driver 5 is applying the ON voltage $V_{ON}$ to one of the selection scan lines $X_1$ to $X_m$ (i.e., in the selection period $T_{SE}$ of each row), the switching signal Φ changes from low level to high level, and the switching signal inv.Φ changes from high level to low level. A period in which the switching signal Φ is at high level and the switching signal inv.Φ is at low level in the selection period $T_{SE}$ of the selection scan line $X_i$ in the ith row is called the reset period $T_R$ of the ith row.

An example of the switch $S_j$ will be explained below. The switch $S_j$ is made up of first and second N-channel field-effect transistors 31 and 32. The gate of the first transistor 31 is connected to the switching signal input terminal 43, and thus the switching signal inv.Φ is input to the gate of the transistor 31. Also, the gate of the second transistor 32 is connected to the switching signal input terminal 42, and thus the switching signal Φ is input to the gate of the transistor 32. The drain of the first transistor 31 is connected to the current line $Y_j$, and the source of the transistor 31 is connected to the current terminal $CT_j$. The drain of the transistor 32 is connected to the current line $Y_j$. The source of the transistor 32 is connected to the reset input terminal 41, and the reset voltage $V_R$ which is a constant voltage is applied to the source of the transistor 32. In this arrangement, when the switching signal Φ is at high level and the switching signal inv.Φ is at low level, the transistor 32 is turned on, and the transistor 31 is turned off. When the switching signal Φ is at low level and the switching signal inv.Φ is at high level, the transistor 31 is turned on, and the transistor 32 is turned off. The transistors 31 and 32 can be fabricated in the same steps as the transistors 21 to 23 of the pixel circuits $D_{1,1}$ to $D_{m,n}$.

Figure 6:
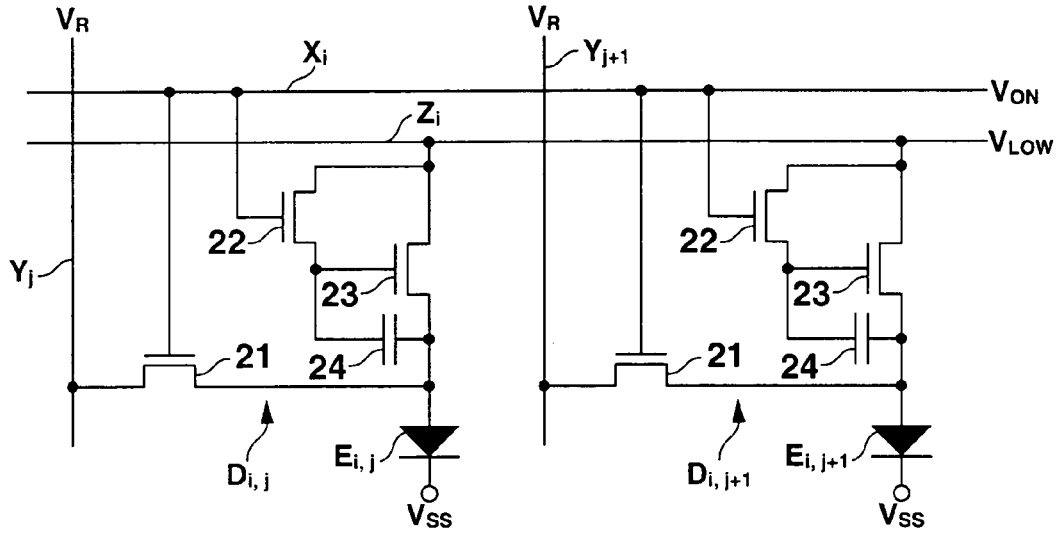
FIG. 6 shows an equivalent circuit diagram of two adjacent pixels $P_{i,j}$ and $P_{i,j+1}$ in the ith row, and the states of electric currents and voltages in a reset period $T_R$ of the ith row.
Figure 7:
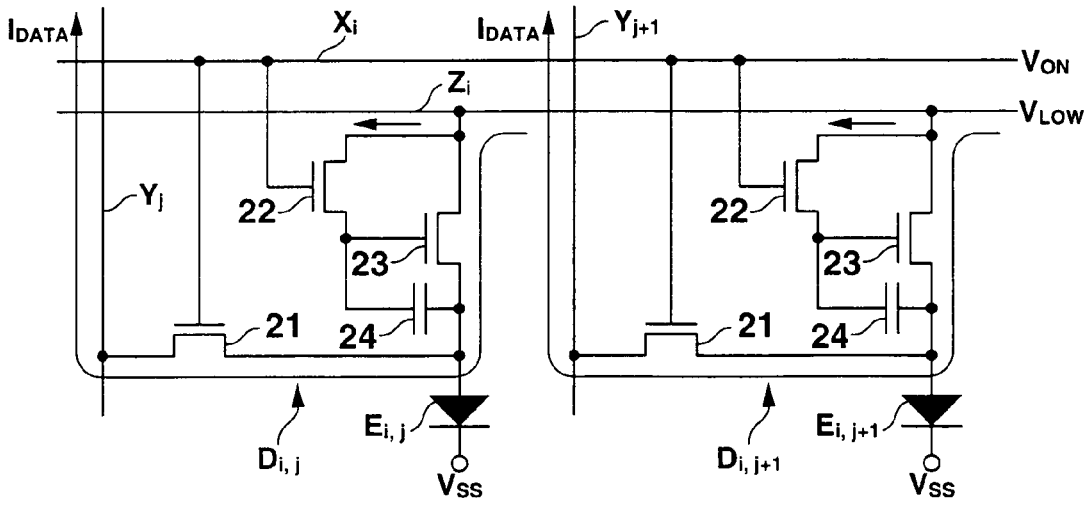
FIG. 7 shows the equivalent circuit diagram of the two adjacent pixels $P_{i,j}$ and $P_{i,j+1}$ in the ith row, and the states of electric currents and voltages after the reset period $T_R$ in a selection period $T_{SE}$ of the ith row.
Figure 8:
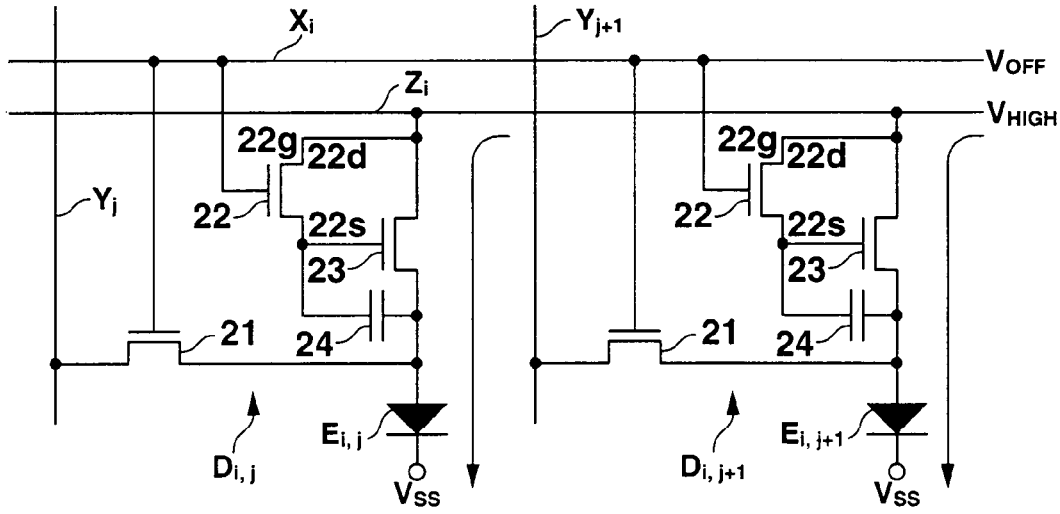
FIG. 8 shows the equivalent circuit diagrams of the two adjacent pixels $P_{i,j}$ and $P_{i,j+1}$ in the ith row, and the states of electric currents and voltages in a non-selection period $T_{NSE}$ of the ith row.

The functions of the pixel circuits $D_{1,1}$ to $D_{m,n}$ will be described below with reference to FIGS. 6 to 8. In FIGS. 6 to 8, the flows of electric currents are indicated by arrows.

FIG. 6 is a circuit diagram showing the states of the voltages in the reset period $T_R$ of the selection period $T_{SE}$ of the ith row. As shown in FIG. 6, in the reset period $T_R$ of the ith row, the selection scan driver 5 applies the ON voltage $V_{ON}$ to the selection scan line $X_i$, and the voltage supply driver 6 applies the tone designating current reference voltage $V_{LOW}$ to the voltage supply line $Z_i$. In addition, in the reset period $T_R$ of the ith row, the switches $S_1$ to $S_n$ apply the reset voltage $V_R$ to the current lines $Y_1$ to $Y_n$. In the reset period $T_R$ of the ith row, therefore, the first transistors 21 of the pixel circuits $D_{i,1}$ to $D_{i,n}$ are ON. Consequently, as shown in FIG. 4, the voltages of the pixel electrodes 51 of the organic EL elements $E_{i,1}$ to $E_{i,n}$, the drains 21*d* of the first transistors 21 in the ith row, the electrodes 24B of the capacitors 24 in the ith row, the sources 23*s* of the driving transistors 23 in the ith row, and the current lines $Y_1$ to $Y_n$ are set in a steady state by the reset voltage $V_R$, thereby discharging the electric charge stored by these parasitic capacitances in the preceding selection period $T_{SE}$. Accordingly, the tone designating current $I_{DATA}$ having a steady current value can be rapidly written in the next selection period $T_{SE}$.

The parasitic capacitances of the organic. EL elements $E_{i,1}$ to $E_{i,n}$ are particularly large. Therefore, when the tone designating current $I_{DATA}$ having a low current value is written, it takes a long time to make the current value steady by resetting the electric charge written in the organic EL element in the preceding frame period $T_{SC}$ if the reset voltage $V_R$ is not applied in the selection period $T_{SE}$. However, the reset voltage $V_R$ is forcedly applied in the selection period $T_{SE}$, so the parasitic capacitance of the organic EL element can be rapidly discharged. Also, when the reset voltage $V_R$ of the ith row, which is applied in the selection period $T_{SE}$ is made equal to that of the voltage supply line $Z_i$ in the ith row, the voltages of the electrodes 24A and 24B of the capacitor 24 become equal to each other, so the electric charges written in the capacitor 24 in the preceding frame period $T_{SC}$ are removed.

In addition, although the second transistors 22 and driving transistors 23 of the pixel circuits $D_{i,1}$ to $D_{i,n}$ are ON, the tone designating current reference voltage $V_{LOW}$ equal to or lower than the reference voltage $V_{SS}$ is applied to the voltage supply line $Z_i$, so the tone designating current $I_{DATA}$ which flows from the voltage supply line $Z_i$ to the driving transistors 23 does not flow through the organic EL elements $E_{i,1}$ to $E_{i,n}$.

FIG. 7 is a circuit diagram showing the states of the electric currents and voltages after the reset period $T_R$ in the selection period $T_{SE}$ of the ith row. As shown in FIG. 7, after the reset period $T_R$ in the selection period $T_{SE}$ of the ith row, the selection scan driver 5 keeps applying the ON voltage $V_{ON}$ to the selection scan line $X_i$, and the voltage supply driver 6 keeps applying the tone designating current reference voltage $V_{LOW}$ to the voltage supply line $Z_i$. In addition, after the reset period $T_R$ in the selection period $T_{SE}$ of the ith row, the current source driver 3 controls the switches $s_1$ to $s_n$ to supply the tone designating current $I_{DATA}$ from the current lines $Y_1$ to $Y_n$ to the current terminals $CT_1$ to $CT_n$. In the selection period $T_{SE}$ of the ith row, the second transistors 22 of the pixel circuits $D_{i,1}$ to $D_{i,n}$ in the ith row are ON. Since the second transistors 22 of the pixel circuits $D_{i,1}$ to $D_{i,n}$ are ON, the voltage is also applied to the gates 23*g* of the driving transistors 23 of the pixel circuits $D_{i,1}$ to $D_{i,n}$, so the driving transistors 23 of the pixel circuits $D_{i,1}$ to $D_{i,n}$ are turned on. Furthermore, since the first transistors 21 of the pixel circuits $D_{i,1}$ to $D_{i,n}$ are also ON, the first transistors 21 of the pixel circuits $D_{i,l}$ to $D_{i,n}$ supply the tone designating current $I_{DATA}$ from the voltage supply line $Z_i$ to the current lines $Y_1$ to $Y_n$ via the drains 23*d* and sources 23*s* of the driving transistors 23. In this state, as shown in FIG. 4, the voltage of the current line $Y_j$ drops until the tone designating current $I_{DATA}$ becomes steady. Also, although the driving transistors 23 of the pixel circuits $D_{i,1}$ to $D_{i,n}$ are ON, the low-level tone designating current reference voltage $V_{LOW}$ is applied to the voltage supply line $Z_i$, so no electric current flows from the voltage supply line $Z_i$ to the organic EL elements $E_{i,1}$ to $E_{i,n}$. Therefore, the current value of the tone designating current $I_{DATA}$ flowing through the current lines $Y_1$ to $Y_n$ becomes equal to the current value of the electric current $I_{DS}$ between the drain 23*d* and source 23*s* of the driving transistor 23. In addition, the level of the voltage between the gate 23*g* and source 23*s* of the driving transistor 23 follows the current value of the tone designating current $I_{DATA}$ which flows from the drain 23*d* to the source 23*s*. Accordingly, the driving transistor 23 converts the current value of the tone designating current $I_{DATA}$ into the level of the voltage between the gate 23*g* and source 23*s*, and electric charges corresponding to the level of the voltage between the gate 23*g* and source 23*s* of the driving transistor 23 are held in the capacitor 24. Note that the gate 23*g* and drain 23*d* of the driving transistor 23 are connected via the second transistor 22, and the ON resistance of the second transistor 22 upon selection is negligibly low. Therefore, the voltage applied to the gate 23*g* and the voltage applied to the drain 23*d* of the driving transistor 23 are substantially equal, so the tone designating current $I_{DATA}$ becomes the electric current $I_{DS}$ which changes on the broken line $V_{TH}$ shown in FIG. 5. That is, when the voltages of the gate 23*g* and drain 23*d* of the driving transistor 23 are equal, the voltage $V_{DS}$ between the source 23*s* and drain 23*d* is equal to the threshold voltage $V_{TH}$ between the unsaturated and saturated regions.

FIG. 8 is a circuit diagram showing the states of the electric currents and voltages in the non-selection period $T_{NSE}$ of the ith row. As shown in FIG. 8, in the non-selection period $T_{NSE}$ of the ith row, the selection scan driver 5 applies the OFF voltage $V_{OFF}$ to the selection scan line $X_i$, and the voltage supply driver 6 applies the driving current reference voltage $V_{HIGH}$ to the voltage supply line $Z_i$.

In the non-selection period $T_{NSE}$ of the ith row, the first transistors 21 of the pixel circuits $D_{i,1}$ to $D_{i,n}$ are OFF. Therefore, the first transistors 21 of the pixel circuits $D_{i,1}$ to $D_{i,n}$ shut off the tone designating current $I_{DATA}$ flowing through the current lines $Y_1$ to $Y_n$, thereby preventing an electric current from flowing from the voltage supply line $Z_i$ to the current lines $Y_1$ to $Y_n$ via the driving transistors 23. In addition, since the second transistor 22 of each of the pixel circuits $D_{i,1}$ to $D_{i,n}$ in the ith row is turned off, the second transistor 22 confines the electric charges in the capacitor 24. In this manner, the second transistor 22 holds the level of the converted voltage between the gate 23*g* and source 23*s* of the driving transistor 23, thereby storing the current value of the electric current which flows through the source-to-drain path of the driving transistor 23. In this state, the high-level driving current reference voltage $V_{HIGH}$ by which the source-to-drain voltage $V_{DS}$ of the driving transistor 23 maintains the saturated region is applied to the voltage supply line $Z_i$, and the driving transistor 23 of each of the pixel circuits $D_{i,1}$ to $D_{i,n}$ is ON. Accordingly, each driving transistor 23 supplies the driving current from the voltage supply line $Z_i$ to a corresponding one of the organic EL elements $E_{i,1}$ to $E_{i,n}$ to allow it to emit light at luminance corresponding to the current value of the driving current. In this state, the level of the converted voltage between the gate 23$g$ and source 23$s$ of the driving transistor 23 of each of the pixel circuits $D_{i,1}$ to $D_{i,n}$ is held by the capacitor 24 so as to be equal to the level of the voltage when the tone designating current $I_{DATA}$ flows through a corresponding one of the current lines $Y_1$ to $Y_n$ in the second half of the selection period $T_{SE}$.

As shown in FIG. 5, a divided voltage $V_{EL}$ of each of the organic EL elements $E_{i,1}$ to $E_{i,n}$ in the non-selection period $T_{NSE}$ is obtained by subtracting, from the driving current reference voltage $V_{HIGH}$, the voltage $V_{DS}$ on the EL load border line indicated by the alternate long and short dashed line, which is obtained when a driving current (equivalent to $I_{DS}$ shown in FIG. 5) having a current value equal to that of the tone designating current $I_{DATA}$ flows. That is, the voltage difference on the right side of the EL load border line is the divided voltage of one organic EL element. As described above, the divided voltage VEL of the organic EL elements $E_{i,1}$ to $E_{i,n}$ rises as the luminance tone rises. In the non-selection period $T_{NSE}$, the driving current reference voltage $V_{HIGH}$ is set higher than a voltage obtained by adding the divided voltage $V_{EL}$ when the luminance tone of the organic EL elements $E_{i,1}$ to $E_{i,n}$ is a minimum to the ON voltage $V_{DS}$ between the drain 23$d$ and source 23$s$ of the driving transistor at that time, and higher than a voltage obtained by adding the divided voltage $V_{EL}$ when the luminance tone of the organic EL elements $E_{i,1}$ to $E_{i,n}$ is a maximum to the ON voltage $V_{DS}$ between the drain 23$d$ and source 23$s$ of the driving transistor at that time. Also, in the non-selection period $T_{NSE}$, the voltage of the source 23$s$ of the driving transistor 23 rises as the voltage $V_{GS}$ between the gate 23$g$ and source 23$s$, which is held in the selection period $T_{SE}$ rises. Although the capacitor 24 changes the electric charge in the electrode 24B connected to the source 23$s$ accordingly, the voltage $V_{GS}$ between the gate 23$g$ and source 23$s$ is held constant by equally changing the electric charge in the electrode 24A.

As shown in FIG. 5, therefore, between the drain 23$d$ and source 23$s$ of the driving transistor 23 in the non-selection period $T_{NSE}$ is always applied a saturated region voltage, and the current value of the driving current which flows through each of the organic EL elements $E_{i,1}$ to $E_{i,n}$ in the non-selection period $T_{NSE}$ is made equal to the current value of the tone designating current $I_{DATA}$ by the electric charges held between the gate 23$g$ and source 23$s$ in the selection period $T_{SE}$. Also, as shown in FIG. 4, the voltage of the pixel electrodes 51 of the organic EL elements $E_{i,1}$ to $E_{i,n}$ in the non-selection period $T_{NSE}$ rises as the luminance tone rises. This increases the voltage difference between the pixel electrodes 51 and the common electrode as a cathode, and increases the luminance of the organic EL elements $E_{i,1}$ to $E_{i,n}$.

As described above, the luminance (the unit is nit.) of the organic EL elements $E_{i,1}$ to $E_{i,n}$ is uniquely determined by the current value of the tone designating current $I_{DATA}$ which flows through the pixel circuits $D_{i,1}$ to $D_{i,n}$ in the selection period $T_{SE}$.

A method of driving the organic EL display panel 2 by the current source driver 3, selection scan driver 5, voltage supply driver 6, and switches $S_1$ to $S_n$, and the display operation of the organic EL display 1 will be described below.

As shown in FIG. 4, the selection scan driver 5 applies the ON voltage VON in order from the selection scan line $X_1$ in the first row to the selection scan line $X_m$ in the mth row (the selection scan line $X_m$ in the mth row is followed by the selection scan line $X_1$ in the first row), thereby selecting these selection scan lines. In synchronism with this selection by the selection scan driver 5, the voltage supply driver 6 applies the tone designating current reference voltage $V_{LOW}$ in order from the voltage supply line $Z_1$ in the first row to the voltage supply line $Z_m$ in the mth row (the voltage supply line $Z_m$ in the mth row is followed by the voltage supply line $Z_1$ in the first row), thereby selecting these voltage supply lines. In the selection period $T_{SE}$ of each row, the current source driver 3 controls the current terminals $CT_1$ to $CT_n$ to generate the tone designating current $I_{DATA}$ having a current value corresponding to the image signal.

Also, at the start of the selection period $T_{SE}$ of each row (at the end of the selection period $T_{SE}$ of the preceding row), the switching signal Φ changes from low level to high level, the switching signal inv.Φ changes from high level to low level, and the reset voltage $V_R$ which removes the electric charges stored in the current lines $Y_1$ to $Y_n$ and the electric charges stored in the pixel electrodes 51 via the first transistors 21 is applied. In the selection period $T_{SE}$ of each row (at the end of the reset period $T_R$ of each row), the switching signal Φ changes from high level to low level, and the switching signal inv.Φ changes from low level to high level. In the reset period $T_R$ in the initial part of the selection period $T_{SE}$, therefore, the switches $S_1$ to $S_n$ allow the tone designating current $I_{DATA}$ to flow between the current terminals $CT_1$ to $CT_n$ and current lines $Y_1$ to $Y_n$, and shut down the application of the reset voltage $V_R$ to the current lines $Y_1$ to $Y_n$. After the reset period $T_R$ in the selection period $T_{SE}$, the switches $S_1$ to $S_n$ shut off the flow of the electric current between the current terminals $CT_1$ to $CT_n$ and current lines $Y_1$ to $Y_n$, and allow the application of the reset voltage $V_R$ to the current lines $Y_1$ to $Y_n$.

The current value of the tone designating current $I_{DATA}$ decreases as the luminance tone lowers. In this state, the voltages of the current lines $Y_1$ to $Y_n$ and pixel electrodes 51 approximate to the tone designating current reference voltage $V_{LOW}$, i.e., to the reset voltage $V_R$. Also, if the tone designating current $I_{DATA}$ having a large current value flows in the selection period $T_{SE}$ of the preceding row or of the preceding frame period $T_{SC}$, the voltage of the pixel electrodes 51 become much lower than the reset voltage $V_R$ via the current lines $Y_1$ to $Y_n$ and first transistors 21.

If, therefore, no reset voltage is applied to the current lines $Y_1$ to $Y_n$ without forming the switches $S_1$ to $S_n$, and the tone designating current $I_{DATA}$ having a low luminance tone and low current value is to be kept supplied to the ith row, the amount of electric charges to be modulated is large because the electric charges of the current lines $Y_1$ to $Y_n$, which are stored in accordance with the tone designating current $I_{DATA}$ having a large current value in the selection period $T_{SE}$ of the (i−1)th row are held in the parasitic capacitances of the current lines $Y_1$ to $Y_n$. Accordingly, it takes a long time to obtain a desired current value of the tone designating current $I_{DATA}$.

Likewise, if no reset voltage is applied to the pixel electrodes 51 in the selection period without forming the switches $S_1$ to $S_n$, and the tone designating current $I_{DATA}$ having a low luminance tone and low current value is to be kept supplied in the next frame period $T_{SC}$, the amount of electric charges to be modulated are large because the electric charges of the pixel electrodes 51 in the ith row, which are stored in accordance with the tone designating current $I_{DATA}$ having a large current value in the selection period $T_{SE}$ of the frame period $T_{SC}$ before the next frame period $T_{SC}$ are held in the parasitic capacitances of the pixel electrodes 51 in the ith row. Accordingly, it takes a long time to obtain a desired current value of the tone designating current $I_{DATA}$.

In the selection period $T_{SE}$, therefore, no sufficient electric charges can be held so that the required voltage is obtained between the gate 23$g$ and source 23$s$ of the driving transistor 23. As a consequence, the driving current in the non-selection period $T_{NSE}$ becomes different from the tone designating current $I_{DATA}$, and this makes accurate tone display impossible.

Since, however, the switches $S_1$ to $S_n$ which apply the reset voltage $V_R$ in the reset period $T_R$ are provided, the electric charges stored in the current lines $Y_1$ to $Y_n$ and the electric charges stored in the pixel electrodes 51 via the first transistors 21 can be rapidly removed. Accordingly, the voltage between the gate 23*g* and source 23*s* of the driving transistor 23 can be rapidly set to a voltage by which the tone designating current $I_{DATA}$ having a low luminance tone and low current value flows. Since this makes high-speed display possible, images particularly excellent in motion image characteristics can be displayed.

Figure 9:
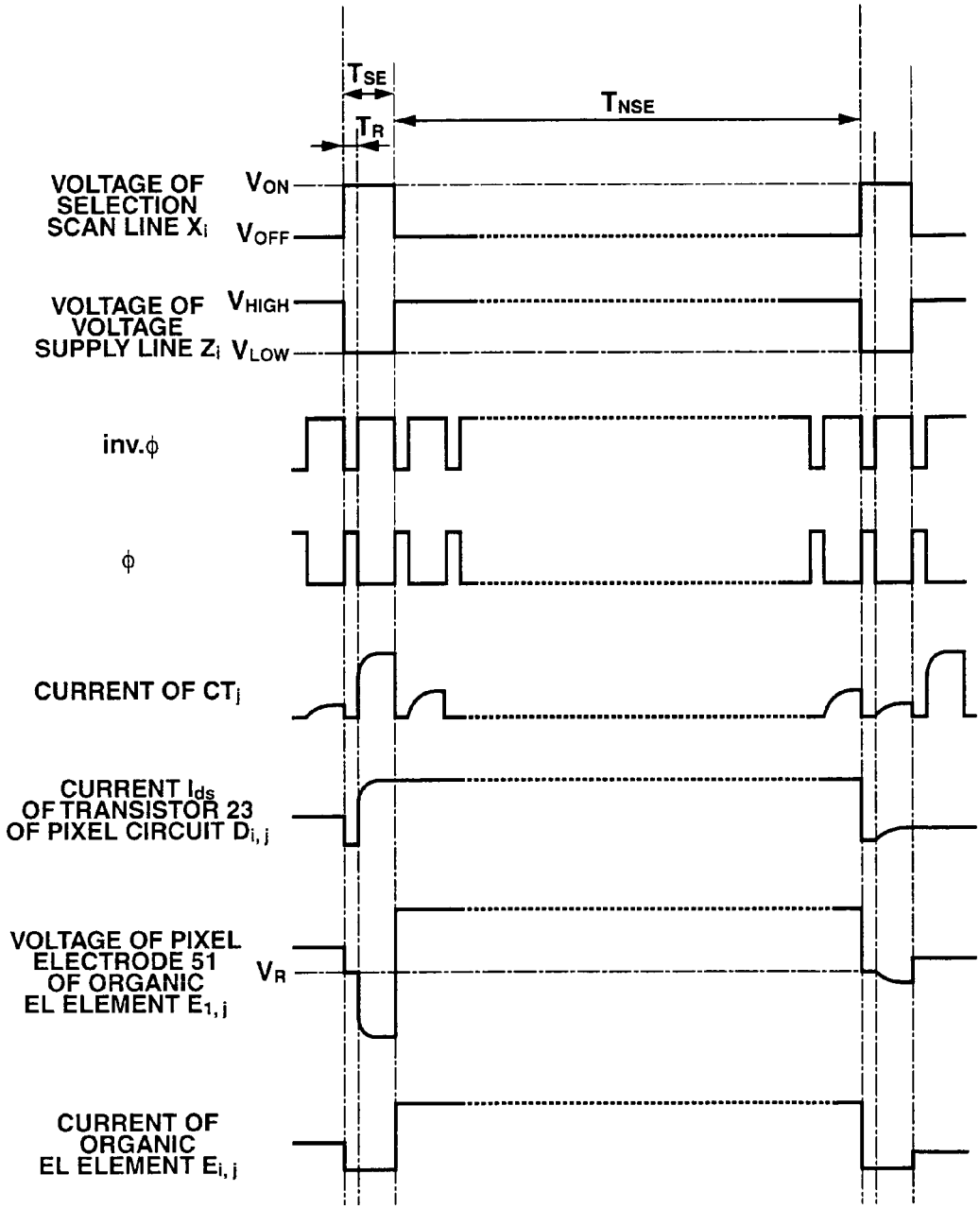
FIG. 9 is a timing chart showing the levels of electric currents and voltages pertaining to the pixel $P_{i,j}$.

FIG. 9 is a timing chart showing, from above, the voltage of the selection scan line $X_1$, the voltage of the voltage supply line $Z_1$, the switching signal inv.Φ, the switching signal Φ, the current value of the current terminal $CT_j$, the current value of an electric current which flows through the driving transistor 23 of the pixel circuit $D_{i,j}$, the voltage of the pixel electrode 51 of the organic EL element $E_{i,j}$, and the current value of an electric current which flows through the organic EL element $E_{i,j}$. Referring to FIG. 9, the abscissa represents the common time.

As shown in FIGS. 6 and 9, when the selection scan driver 5 applies the ON voltage $V_{ON}$ to the selection scan line $X_i$ in the ith row (i.e., in the selection period $T_{SE}$ of the ith row), the OFF voltage $V_{OFF}$ is applied to the other selection scan lines $X_1$ to $X_m$ (except for $X_i$). In the selection period $T_{SE}$ of the ith row, therefore, the first and second transistors 21 and 22 of the pixel circuits $D_{i,1}$ to $D_{i,n}$ in the ith row are ON, and the first and second transistors 21 and 22 of the pixel circuits $D_{1,1}$ to $D_{m,n}$ (except for $D_{i,1}$ to $D_{i,n}$) in the other rows are OFF.

As described above, in the selection period $T_{SE}$ of the ith row, the tone designating current reference voltage $V_{LOW}$ is applied to the voltage supply line $Z_i$, and the second transistors 22 of the pixel circuits $D_{i,1}$ to $D_{i,n}$ in the ith row are ON. Accordingly, the voltage is also applied to the gates 23*g* of the driving transistors 23 of the pixel circuits $D_{i,1}$ to $D_{i,n}$ in the ith row, so the driving transistors 23 are turned on.

In the reset period $T_R$ in the initial part of the selection period $T_{SE}$ of the ith row, the transistors 32 of the switches $S_1$ to $S_n$ are turned on. Therefore, the voltage supply line $Z_i$ is electrically connected to the reset input terminal 41 via the driving transistors 23 and first transistors 21 of the pixel circuits $D_{i,1}$ to $D_{i,n}$ and the current lines $Y_1$ to $Y_n$. In this state, the voltage applied from the voltage supply line $Z_i$ to the reset input terminal 41 via the driving transistors 23 and first transistors 21 of the pixel circuits $D_{i,1}$ to $D_{i,n}$ and the current lines $Y_1$ to $Y_n$ is equal to the reset voltage $V_R$ (=tone designating current reference voltage $V_{LOW}$) which is equal to or lower than the reference voltage $V_{SS}$. Accordingly, the voltage of the pixel electrodes 51 of the organic EL elements $E_{i,1}$ to $E_{i,n}$ is also equal to the reset voltage $V_R$. In addition, since the reset voltage $V_R$ is applied to the current lines $Y_1$ to $Y_n$, the electric charges stored in the parasitic capacitances of the current lines $Y_1$ to $Y_n$ and the electric charges stored in the parasitic capacitances of the pixel circuits $D_{i,1}$ to $D_{i,n}$ including the pixel electrodes 51 are removed, so the voltage of these components becomes equal to the reset voltage $V_R$. As a consequence, the organic EL elements $E_{i,1}$ to $E_{i,n}$ stop emitting light immediately after the start of the reset period $T_R$ of the ith row.

As shown in FIGS. 7 and 9, in the second half of the selection period $T_{SE}$ after the reset period $T_R$, the ON voltage $V_{ON}$ is applied to the selection scan line $X_i$ in the ith row, and the tone designating current reference voltage $V_{LOW}$ is applied to the voltage supply line $Z_i$ in the ith row. Therefore, the first transistors 21, second transistors 22, and driving transistors 23 of the pixel circuits $D_{i,1}$ to $D_{i,n}$ in the ith row are ON. After the reset period $T_R$ in the selection period $T_{SE}$, the transistors 31 of the switches $S_1$ to $S_n$ are turned on, so the switches $S_1$ to $S_n$ allow an electric current to flow between the current terminals $CT_1$ to $CT_n$ and current lines $Y_1$ to $Y_n$. As a consequence, the current terminals $CT_1$ to $CT_n$ are electrically connected to the voltage supply line $Z_i$ in the ith row. In this state, the current source driver 3 supplies the tone designating current $I_{DATA}$ from the voltage supply line $Z_i$ to the current terminals $CT_1$ to $CT_n$ via the driving transistors 23 and first transistors 21 of the pixel circuits $D_{i,1}$ to $D_{i,n}$ the current lines $Y_1$ to $Y_n$, and the switches $S_1$ to $S_n$. Until the end of the selection period $T_{SE}$ of the ith row, the current source driver 3 controls the current value of the tone designating current $I_{DATA}$ supplied to the current lines $Y_1$ to $Y_n$ such that the current value is held constant in accordance with the image signal.

In the second half of the selection period $T_{SE}$ of the ith row, the tone designating current $I_{DATA}$ flows along the voltage supply line $Z_i$→the path between the drain 23*d* and source 23*s* of the driving transistor 23 of each of the pixel circuits $D_{i,1}$ to $D_{i,n}$→the path between the drain 21*d* and source 21*s* of the first transistor 21 of each of the pixel circuits $D_{i,1}$ to $D_{i,n}$→the current lines $Y_1$ to $Y_n$→the transistors 31 of the switches $S_1$ to $S_n$→the current terminals $CT_1$ to $CT_n$ of the current source driver 3. In the selection period $T_{SE}$ of the ith row, therefore, the voltage applied from the voltage supply line $Z_i$ to the current terminals $CT_1$ to $CT_n$ via the driving transistors 23 and first transistors 21 of the pixel circuits $D_{i,1}$ to $D_{i,n}$ and the current lines $Y_1$ to $Y_n$ becomes steady.

That is, since the voltage applied from the voltage supply line $Z_i$ in the ith row to the current terminals $CT_1$ to $CT_n$ becomes steady, the voltage having a level corresponding to the current value of the tone designating current $I_{DATA}$ which flows through the driving transistor 23 is applied between the gate 23*g* and source 23*s* of the driving transistor 23, so electric charges corresponding to the level of this voltage between the gate 23*g* and source 23*s* of the driving transistor 23 is held in the capacitor 24. Consequently, the current value of the tone designating current $I_{DATA}$ which flows through the driving transistor 23 of each of the pixel circuits $D_{i,1}$ to $D_{i,n}$ in the ith row is converted into the level of the voltage between the gate 23*g* and source 23*s* of the driving transistor 23.

In the reset period $T_R$ of the ith row as described above, the reset voltage $V_R$ is applied to the current lines $Y_1$ to $Y_n$. Therefore, the voltage applied from the voltage supply line $Z_i$ to the reset input terminal 41 via the driving transistors 23 and first transistors 21 of the pixel circuits $D_{i,1}$ to $D_{i,n}$ and the current lines $Y_1$ to $Y_n$ can be made steady. Accordingly, even if a weak tone designating current $I_{DATA}$ flows through the current lines $Y_1$ to $Y_n$ after the reset period $T_R$ of the ith row, electric charges corresponding to the tone designating current $I_{DATA}$ can be rapidly held in the capacitors 24 of the pixel circuits $D_{i,1}$ to $D_{i,n}$.

As described above, the current value of the electric current which flows between the drain 23*d* and source 23*s* of the driving transistor 23 of each of the pixel circuits $D_{i,1}$ to $D_{i,n}$ in the ith row and the level of the voltage between the source 23*s* and gate 23*g* are overwritten from those of the preceding frame period $T_{SC}$. In the selection period $T_{SE}$ Of the ith row, therefore, the magnitude of the electric charges which are held in the capacitor 24 of each of the pixel circuits $D_{i,1}$ to $D_{i,n}$ in the ith row is overwritten from that of the preceding frame period $T_{SC}$.

The potential at arbitrary points in the paths from the driving transistors 23 of the pixel circuits $D_{i,1}$ to $D_{i,n}$ to the current lines $Y_1$ to $Y_n$ via the first transistors 21 changes in accordance with, e.g., the internal resistances of the transistors 21, 22, and 23, which change with time. In this embodiment, however, in the selection period $T_{SE}$, the current source driver 3 forcedly supplies the tone designating current $I_{DATA}$ from the driving transistors 23 of the pixel circuits $D_{i,1}$ to $D_{i,n}$ to the current lines $Y_1$ to $Y_n$ via the first transistors 21. Therefore, even if the internal resistances of the transistors 21, 22, and 23 change with time, the tone designating current $I_{DATA}$ takes a desired current value.

Also, in the selection period $T_{SE}$ of the ith row, the common electrode of the organic EL elements $E_{i,1}$ to $E_{i,n}$ in the ith row is at the reference voltage $V_{SS}$, and the voltage supply line $Z_i$ is at the tone designating current reference voltage $V_{LOW}$ which is equal to or lower than the reference voltage $V_{SS}$. As a consequence, a reverse bias voltage is applied to the organic EL elements $E_{i,1}$ to $E_{i,n}$ in the ith row. Accordingly, no electric current flows through the organic EL elements $E_{i,1}$ to $E_{i,n}$ in the ith row, so the organic EL elements $E_{i,1}$ to $E_{i,n}$ do not emit light.

Subsequently, as shown in FIGS. 8 and 9, at the end time of the selection period $T_{SE}$ of the ith row (at the start time of the non-selection period $T_{NSE}$ of the ith row), a signal output from the selection scan driver 5 to the selection scan line $X_i$ changes from the high-level ON voltage $V_{ON}$ to the low-level OFF voltage $V_{OFF}$. That is, the selection scan driver 5 applies the OFF voltage $V_{OFF}$ to the gate 21*g* of the first transistor 21 and the gate 22*g* of the second transistor 22 of each of the pixel circuits $D_{i,1}$ to $D_{i,n}$ in the ith row.

In the non-selection period $T_{NSE}$ Of the ith row, therefore, the first transistors 21 of the pixel circuits $D_{i,1}$ to $D_{i,n}$ in the ith row are turned off to prevent the electric current from flowing from the voltage supply line $Z_i$ to the current lines $Y_1$ to $Y_n$. In addition, in the non-selection period $T_{NSE}$ of the ith row, when the second transistors 22 of the pixel circuits $D_{i,1}$ to $D_{i,n}$ in the ith row are turned off, the electric charges held in the capacitors 24 in the immediately preceding selection period $T_{SE}$ of the ith row are confined by the second transistors 22. Accordingly, the driving transistor 23 of each of the pixel circuits $D_{i,1}$ to $D_{i,n}$ in the ith row is kept ON in the non-selection period $T_{NSE}$. That is, in each of the pixel circuits $D_{i,1}$ to $D_{i,n}$ in the ith row, the voltage $V_{GS}$ between the gate 23*g* and source 23*s* of the driving transistor 23 in the non-selection period $T_{NSE}$ becomes equal to the voltage $V_{GS}$ between the gate 23*g* and source 23*s* of the driving transistor 23 in the immediately preceding selection period $T_{SE}$, i.e., the capacitor 24 in which the electric charges on the side of the electrode 24A are held by the second transistor 22 holds the voltage $V_{GS}$ between the gate 23*g* and source 23*s* of the driving transistor 23.

Also, in the non-selection period $T_{NSE}$ of the ith row, the voltage supply driver 6 applies the driving current reference voltage $V_{HIGH}$ to the voltage supply line $Z_i$ in the ith row. In the non-selection period $T_{NSE}$, the common electrode of the organic EL elements $E_{i,1}$ to $E_{i,n}$ in the ith row is at the reference voltage $V_{SS}$, and the voltage supply line $Z_i$ in the ith row is at the driving current reference voltage $V_{HIGH}$ which is higher than the reference voltage $V_{SS}$, so the driving transistors 23 of the pixel circuits $D_{i,1}$ to $D_{i,n}$ in the ith row are ON. As a consequence, a forward bias voltage is applied to the organic EL elements $E_{i,1}$ to $E_{i,n}$. In the pixel circuits $D_{i,1}$ to $D_{i,n}$, therefore, a driving current flows from the voltage supply line $Z_i$ to the organic EL elements $E_{i,1}$ to $E_{i,n}$ via the driving transistors 23, and thus the organic EL elements $E_{i,1}$ to $E_{i,n}$ emit light.

More specifically, in the pixel circuit $D_{i,j}$ in the non-selection period $T_{NSE}$ of the ith row, the first transistor 21 electrically shuts off the path between the current line $Y_j$ and driving transistor 23, and the second transistor 22 confines the electric charges in the capacitor 24. In this manner, the level of the voltage, which is converted in the selection period $T_{SE}$, between the gate 23*g* and source 23*s* of the driving transistor 23 is held, and a driving current having a current value corresponding to the level of this voltage held between the gate 23*g* and source 23*s* is supplied to the organic EL element $E_{i,j}$ by the driving transistor 23.

In this state, the current value of the driving current which flows through the organic EL elements $E_{i,1}$ to $E_{i,n}$ in the selection period $T_{SE}$ of the ith row is equal to the current value of the electric current which flows through the driving transistors 23 of the pixel circuits $D_{i,1}$ to $D_{i,n}$, and therefore equal to the current value of the tone designating current $I_{DATA}$ which flows through the driving transistors 23 of the pixel circuits $D_{i,1}$ to $D_{i,n}$ in the selection period $T_{SE}$. As described above, in the selection period $T_{SE}$, the current value of the tone designating current $I_{DATA}$ which flows through the driving transistors 23 of the pixel circuits $D_{i,1}$ to $D_{i,n}$ is a desired current value. Therefore, a driving current having a desired current value can be supplied to the organic EL elements $E_{i,1}$ to $E_{i,n}$, so the organic EL elements $E_{i,1}$ to $E_{i,n}$ can emit light at a desired tone luminance.

In the reset period $T_R$ of the (i+1)th row after the selection period $T_{SE}$ of the ith row, as in the reset period $T_R$ of the ith row, the transistors 31 of the switches $S_1$ to $S_n$ are turned off, and the transistors 32 of the switches $S_1$ to $S_n$ are turned on. Accordingly, in the reset period $T_R$ of the (i+1)th row, the tone designating current $I_{DATA}$ does not flow through any of the current lines $Y_1$ to $Y_n$, but the reset voltage $V_R$ is applied to all the current lines $Y_1$ to $Y_n$, the pixel electrodes 51 in the (i+1)th row, the electrodes 24B of the capacitors 24 in the (I+1)th row, and the sources 23*s* of the driving transistors 23 in the (i+1)th row. After the reset period $T_R$ in the selection period $T_{SE}$ of the (i+1)th row, as in the case of the ith row, the selection scan driver 5 selects the selection scan line $X_{i+1}$ in the (i+1)th row, so the tone designating current $I_{DATA}$ flows from the voltage supply line $Z_i$ to the current terminals $CT_1$ to $CT_n$ via the driving transistors 23 and first transistors 21 of the pixel circuits $D_{i,1}$ to $D_{i,n}$, the current lines $Y_1$ to $Y_n$, and the switches $D_{i,1}$ to $D_{i,n}$.

As described above, in the reset period $T_R$, the reset voltage $V_R$ is forcedly applied to, e.g., the current lines $Y_1$ to $Y_n$ and the pixel electrodes 51. Therefore, the charge amount of the parasitic capacitances of the current lines $Y_1$ to $Y_n$ and the like approximates to the charge amount in a steady state in which a small electric current flows. Accordingly, even when the electric current which flows through the current lines $Y_1$ to $Y_n$ after the reset period $T_R$ of the (i+1)th row is weak, a steady state can be immediately obtained.

In this embodiment as described above, the current value of the driving current which flows through the organic EL elements $E_{1,1}$ to $E_{m,n}$ in the non-selection period $T_{NSE}$ is represented by the current value of the tone designating current $I_{DATA}$ after the reset period $T_R$ of the selection period $T_{SE}$. Therefore, even when variations are produced in characteristics of the driving transistors 23 of the pixel circuits $D_{1,1}$ to $D_{m,n}$, no variations are produced in luminance of the organic EL elements $E_{1,1}$ to $E_{m,n}$ if the current value of the tone designating current $I_{DATA}$ remains the same for all the pixel circuits $D_{1,1}$ to $D_{m,n}$. That is, this embodiment can suppress planar variations by which pixels have different luminance values even though luminance tone signals having the same level are output to these pixels. Accordingly, the organic EL display 1 of this embodiment can display high-quality images.

The tone designating current $I_{DATA}$ is very weak because it is equal to the current value of the electric current which flows through the organic EL elements $E_{1,1}$ to $E_{m,n}$ in accordance with the luminance of the organic EL elements $E_{1,1}$ to $E_{m,n}$ which emit light. The wiring capacitances of the current lines $Y_1$ to $Y_n$ delay the tone designating current $I_{DATA}$ which flows through the current lines $Y_1$ to $Y_n$. If the selection period $T_{SE}$ is short, therefore, electric charges corresponding to the tone designating current $I_{DATA}$ cannot be held in the gate-to-source path of the driving transistor 23. In this embodiment, however, the reset voltage $V_R$ is forcedly applied to the current lines $Y_1$ to $Y_n$ in the reset period $T_R$ of each row. Therefore, even if the tone designating current $I_{DATA}$ is weak or the selection period $T_{SE}$ is short, electric charges corresponding to the tone designating current $I_{DATA}$ can be held in the gate-to-source path of the driving transistor 23 within the selection period $T_{SE}$.

Also, in this embodiment, the data driving circuit 7 applies the reset voltage $V_R$ to the current lines $Y_1$ to $Y_n$ in the selection period $T_{SE}$. Therefore, the first transistor 21 has both the function of a switching element which loads the reset voltage $V_R$ into each of the pixel circuits $D_{1,1}$ to $D_{m,n}$, and the function of a switching element which loads the tone designating current $I_{DATA}$ into each of the pixel circuits $D_{1,1}$ to $D_{m,n}$. This makes it unnecessary to form any switching $T_{FT}$, which loads a blanking signal into a pixel circuit as in the conventional device (Jpn. Pat. Appln. KOKAI Publication No. 2000-221942), in the pixel circuits $D_{1,1}$ to $D_{m,n}$ in addition to the first transistors 21. Accordingly, the number of transistors necessary for the pixel circuits $D_{1,1}$ to $D_{m,n}$ does not increase. When the organic EL elements $E_{1,1}$ to $E_{m,n}$ are formed on the same surface as the pixel circuits $D_{1,1}$ to $D_{m,n}$, therefore, the aperture ratio of the pixels $P_{1,1}$ to $P_{m,n}$ does not decrease.

Second Embodiment

Figure 10:
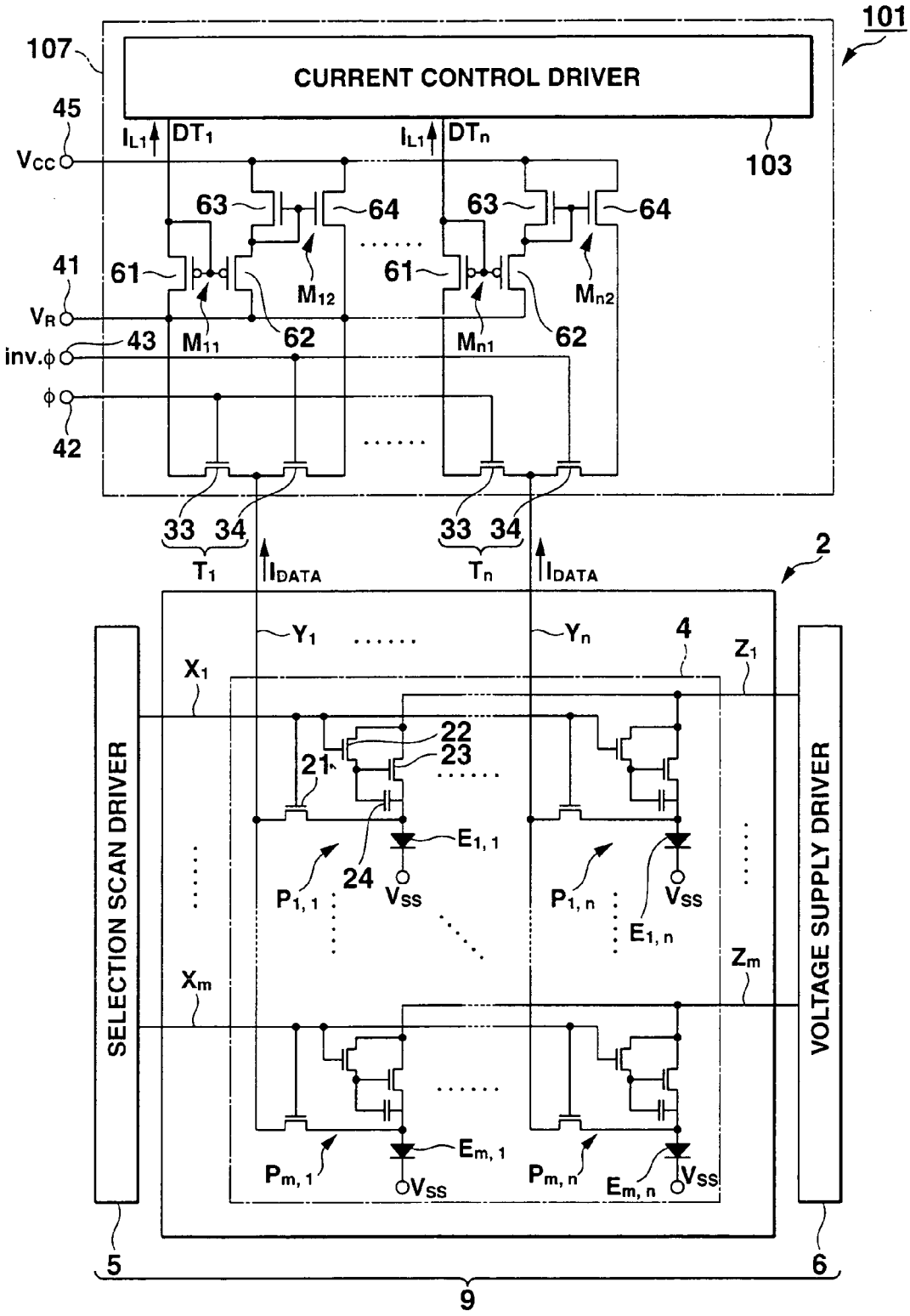
FIG. 10 is a block diagram of an organic electroluminescent display according to the second embodiment of the present invention.

FIG. 10 is a block diagram showing an organic EL display 101 according to the second embodiment to which the organic EL display of the present invention is applied. In FIG. 10, the same reference numerals and symbols as in the organic EL display 1 of the first embodiment denote the same parts in the organic EL display 101, and an explanation thereof will be omitted.

Similar to the organic EL display 1 shown in FIG. 1, the organic EL display 101 includes an organic EL display panel 2, scan driving circuit 9, and data driving circuit 107. The organic EL display panel 2 and scan driving circuit 9 are the same as the organic EL display panel 2 and scan driving circuit 9 of the first embodiment. The data driving circuit 107 is different from the data driving circuit 7 of the first embodiment.

The data driving circuit 107 includes n current terminals $DT_1$ to $DT_n$, a current control driver 103 which supplies a pull current $I_{L1}$ to the current terminals $DT_1$ to $DT_n$, first current mirror circuits $M_{11}$ to $M_{n1}$ and second current mirror circuits $M_{12}$ to $M_{n2}$ which convert the pull current $I_{L1}$ flowing through the current terminals $DT_1$ to $DT_n$ into a tone designating current $I_{DATA}$, and switches $T_1$ to $T_n$ interposed between current lines $Y_1$ to $Y_n$, the first current mirror circuits $M_{11}$ to $M_{n1}$, and the second current mirror circuits $M_{12}$ to $M_{n2}$.

An 8-bit digital tone image signal is input to the current control driver 103. This digital tone image signal loaded into the current control driver 103 is converted into an analog signal by an internal D/A converter of the current control driver 103. The driver 103 generates the pull current $I_{L1}$ having a current value corresponding to the analog image signal at the current terminals $DT_1$ to $DT_n$. The driver 103 supplies the pull current $I_{L1}$ from the first current mirror circuits $M_{11}$ to $M_{n1}$ formed for individual rows to the current terminals $DT_1$ to $DT_n$. In accordance with the pull current $I_{L1}$, the current control driver 103 supplies the tone designating current $I_{DATA}$ from driving transistors 23 in the individual rows to the second current mirror circuits $M_{12}$ to $M_{n2}$ via the current lines $Y_1$ to $Y_n$.

The operation timings of the current control driver 103 are the same as those of the current source driver 3 of the first embodiment. That is, the current control driver 103 controls the current value of the pull current $I_{L1}$ at the current terminals $DT_1$ to $DT_n$ in each selection period $T_{SE}$ of each row in accordance with the image signal, and makes the current value of the pull current $I_{L1}$ steady in a period from the end of each reset period $T_R$ to the end of the corresponding selection period $T_{SE}$. The pull current $I_{L1}$ supplied by the current control driver 103 is larger than and proportional to the tone designating current $I_{DATA}$ supplied by the current source driver 3 of the first embodiment.

The first current mirror circuits $M_{11}$ to $M_{n1}$ and second current mirror circuits $M_{12}$ to $M_{n2}$ convert the pull current $I_{L1}$ which flows through the current terminals $DT_1$ to $DT_n$ into the tone designating current $I_{DATA}$ at a predetermined conversion ratio. Each of the first current mirror circuits $M_{11}$ to $M_{n1}$ is made up of two P-channel MOS transistors 61 and 62. The transistors 61 and 62 can be fabricated by the same steps as the transistors 21 to 23 of each of pixel circuits $D_{1,1}$ to $D_{m,n}$. Each of the second current mirror circuits $M_{12}$ to $M_{n2}$ is made up of two N-channel MOS transistors 63 and 64. The transistors 63 and 64 can be partially fabricated by the same steps as the transistors 21 to 23 of each of the pixel circuits $D_{1,1}$ to $D_{m,n}$.

In the first current mirror circuits $M_{11}$ to $M_{n1}$, the gates and drains of the transistors 61 and the gates of the transistors 62 are connected to the current terminals $DT_1$ to $DT_n$. The sources of the transistors 61 and 62 are connected to a reset input terminal 41 which outputs a reset voltage $V_R$ as a ground voltage.

In the second current mirror circuits $M_{12}$ to $M_{n2}$, the gates and drains of the transistors 63 and the gates of the transistors 64 are connected together to the drains of the transistors 62. The sources of the transistors 63 and 64 are connected to a constant-voltage input terminal 45 to which a negative voltage $V_{CC}$ is applied, and the drains of the transistors 64 are connected to the sources of transistors 34 of the switches $T_1$ to $T_n$ (to be described later). In each of the first current mirror circuits $M_{11}$ to $M_{n1}$, the channel resistance of the transistor 61 is lower than that of the transistor 62. In each of the second current mirror circuits $M_{12}$ to $M_{n2}$, the channel resistance of the transistor 63 is lower than that of the transistor 64.

Each of the switches $T_1$ to $T_n$ has an N-channel MOS transistor 33 and the N-channel MOS transistor 34. The transistors 33 and 34 can be fabricated by the same steps as the transistors 21 to 23 of each of the pixel circuits $D_{1,1}$ to $D_{m,n}$. An example of the switch $T_j$ will be explained below. The gate of the transistor 34 of the switch $T_j$ is connected to a switching signal input terminal 43, and thus a switching signal inv.Φ is input to the gate of the transistor 34. Also, the gate of the transistor 33 is connected to a switching signal input terminal 42, and thus a switching signal Φ is input to the gate of the transistor 33. The drains of the transistors 33 and 34 are connected to the current line $Y_j$, the source of the transistor 33 is connected to the source of the transistor 61 of the first current mirror circuit $M_{i1}$ and the reset input terminal 41, and the source of the transistor 34 is connected to the drain of the transistor 64 of the second current mirror circuit $M_{i2}$.

In this arrangement, when the switching signal Φ is at high level and the switching signal inv.Φ is at low level, the transistor 33 is turned on, and the transistor 34 is turned off. The switching signals Φ and inv.Φ have the same waveforms as in FIG. 4 of the first embodiment. Accordingly, the switches $T_1$ to $T_n$ switch the state in which the tone designating current $I_{DATA}$ obtained by modulating the current value of the pull current $I_{L1}$ by the first current mirror circuits $M_{11}$ to $M_{n1}$ and second current mirror circuits $M_{12}$ to $M_{n2}$ is supplied to the driving transistors 23 and current lines $Y_1$ to $Y_n$, and the state in which the reset voltage $V_R$ is applied to the current lines $Y_1$ to $Y_n$.

When the current control driver 103 supplies the pull current $I_{L1}$ to the current terminal $DT_j$, an electric current which flows through the drain-to-source path of the transistor 62 in the first current mirror circuit $M_{j1}$ has a value obtained by multiplying the ratio of the channel resistance of the transistor 62 to that of the transistor 61 by the current value of the pull current $I_{L1}$ in the drain-to-source path of the transistor 61. In the second current mirror circuit $M_{j2}$, an electric current which flows through the drain-to-source path of the transistor 64 has a value obtained by multiplying the ratio of the channel resistance of the transistor 64 to that of the transistor 63 by the current value of an electric current in the drain-to-source path of the transistor 63. The current value of the electric current in the drain-to-source path of the transistor 63 matches the electric current which flows through the drain-to-source path of the transistor 62. Therefore, the current value of the tone designating current $I_{DATA}$ is obtained by multiplying the ratio of the channel resistance of the transistor 64 to that of the transistor 63 by the value which is obtained by multiplying the ratio of the channel resistance of the transistor 62 to that of the transistor 61 by the current value of the pull current $I_{L1}$ in the drain-to-source path of the transistor 61.

As described above, the first current mirror circuits $M_{11}$ to $M_{n1}$ and second current mirror circuits $M_{12}$ to $M_{n2}$ convert the pull current $I_{L1}$ which flows through the current terminals $DT_1$ to $DT_n$ into the tone designating current $I_{DATA}$. Since the tone designating current $I_{DATA}$ flows through the output sides of the second current mirror circuits $M_{12}$ to $M_{n2}$, i.e., the drains of the transistors 64, these drains of the transistors 64 of the second current mirror circuits $M_{12}$ to $M_{n2}$ are equivalent to the current terminal $CT_j$ of the current source driver 3 of the first embodiment. That is, an arrangement obtained by combining the first current mirror circuits $M_{11}$ to $M_{n1}$, second current mirror circuits $M_{12}$ to $M_{n2}$, and current control driver 103 is equivalent to the current source driver 3 of the first embodiment.

In the first embodiment, the reset voltage $V_R$ is at the same level as the tone designating current reference voltage $V_{LOW}$. In the second embodiment, however, the reset voltage $V_R$ is set at 0 [V]. Therefore, when a voltage $V_{SS}$ is set at the ground voltage, no voltage difference is produced between pixel electrodes 51 as the anodes of the organic EL elements $E_{1,1}$ to $E_{m,n}$ and the common electrode as the cathode. As a consequence, electric charges stored in the pixel electrodes 51 can be easily removed.

In order for the switches $T_1$ to $T_n$ to perform the switching operation, as in the first embodiment, the switching signal Φ is input to the switching signal input terminal 42, and the switching signal inv.Φ is input to the switching signal input terminal 43. The relationship between the timings of the switching signals Φ and inv.Φ and the selection timings of a selection scan driver 5 and voltage supply driver 6 is the same as in the first embodiment. Also, the operation timings of the selection scan driver 5 and voltage supply driver 6 in the second embodiment are the same as in the first embodiment.

In the second embodiment, as in the first embodiment, in the reset period $T_R$ of the former period in the selection period $T_{SE}$ of the ith row, the transistors 33 of the switches $T_1$ to $T_n$ are turned on, so a voltage supply line $Z_i$ is electrically connected to the reset input terminal 41 via the driving transistors 23 and first transistors 21 of the pixel circuits $D_{i,1}$ to $D_{i,n}$ and the current lines $Y_1$ to $Y_n$.

Also, in the reset period $T_R$ of the ith row, the reset voltage $V_R$ is applied to the current lines $Y_1$ to $Y_n$ and pixel electrodes 51, so the electric charges stored in the parasitic capacitances of the current lines $Y_1$ to $Y_n$ and the electric charges stored in the parasitic capacitances of the pixel electrodes 51 can be rapidly removed. Accordingly, even when the weak tone designating current $I_{DATA}$ flows through the current lines $Y_1$ to $Y_n$ after the reset period $T_R$ of the ith row, electric charges corresponding to the tone designating current $I_{DATA}$ can be rapidly held in capacitors 24 of the pixel circuits $D_{i,1}$ to $D_{i,n}$.

In addition, in a non-selection period $T_{NSE}$, the current value of a driving current which flows through the organic EL elements $E_{1,1}$ to $E_{m,n}$ is represented by the current value of the tone designating current $I_{DATA}$ after the reset period $T_R$ of each selection period $T_{SE}$. Therefore, even if variations are produced in Characteristics of the driving transistors 23 of the pixel circuits $D_{1,1}$ to $D_{m,n}$, no variations are produced in driving current because the tone designating current $I_{DATA}$ is forcedly supplied to the driving transistors 23. As a consequence, no variations are produced in luminance of the organic EL elements $E_{1,1}$ to $E_{m,n}$.

Furthermore, since the first current mirror circuits $M_{11}$ to $M_{n1}$ and second current mirror circuits $M_{12}$ to $M_{n2}$ are formed, the current value of the tone designating current $I_{DATA}$ of the current lines $Y_1$ to $Y_n$ is proportional to and smaller than the pull current $I_{L1}$ at the current terminals $DT_1$ to $DT_n$. Accordingly, even if the pull current $I_{L1}$ at the current terminals $DT_1$ to $DT_n$ is unexpectedly reduced by a leakage current produced in the current control driver 103 or the like, the tone designating current $I_{DATA}$ of the current lines $Y_1$ to $Y_n$ does not largely reduce. That is, even a decrease in output from the current control drive 103 caused by a current leak has no large influence on the tone designating current $I_{DATA}$ Of the current lines $Y_1$ to $Y_n$, so the luminance of the organic EL elements $E_{1,1}$ to $E_{m,n}$ does not largely decrease.

In the second embodiment, the data driving circuit 107 can well generate the tone designating current $I_{DATA}$ even when the current control driver 103 cannot generate a weak electric current close to the tone designating current $I_{DATA}$ matching the light emission characteristics of the organic EL elements.

The data driving circuit 107 applies the reset voltage $V_R$ to the current lines $Y_1$ to $Y_n$ in the selection period $T_{SE}$ in the second embodiment as well. Therefore, the first transistor 21 has both the function of a switching element which loads the reset voltage $V_R$ into each of the pixel circuits $D_{1,1}$ to $D_{m,n}$, and the function of a switching element which loads the tone designating current $I_{DATA}$ into each of the pixel circuits $D_{1,1}$ to $D_{m,n}$. Accordingly, the number of transistors necessary for the pixel circuits $D_{1,1}$ to $D_{m,n}$ does not increase. When the organic EL elements $E_{1,1}$ to $E_{m,n}$ are formed on the same surface as the pixel circuits $D_{1,1}$ to $D_{m,n}$, therefore, the aperture ratio of the pixels $P_{1,1}$ to $P_{m,n}$ does not decrease.

Third Embodiment

Figure 11:
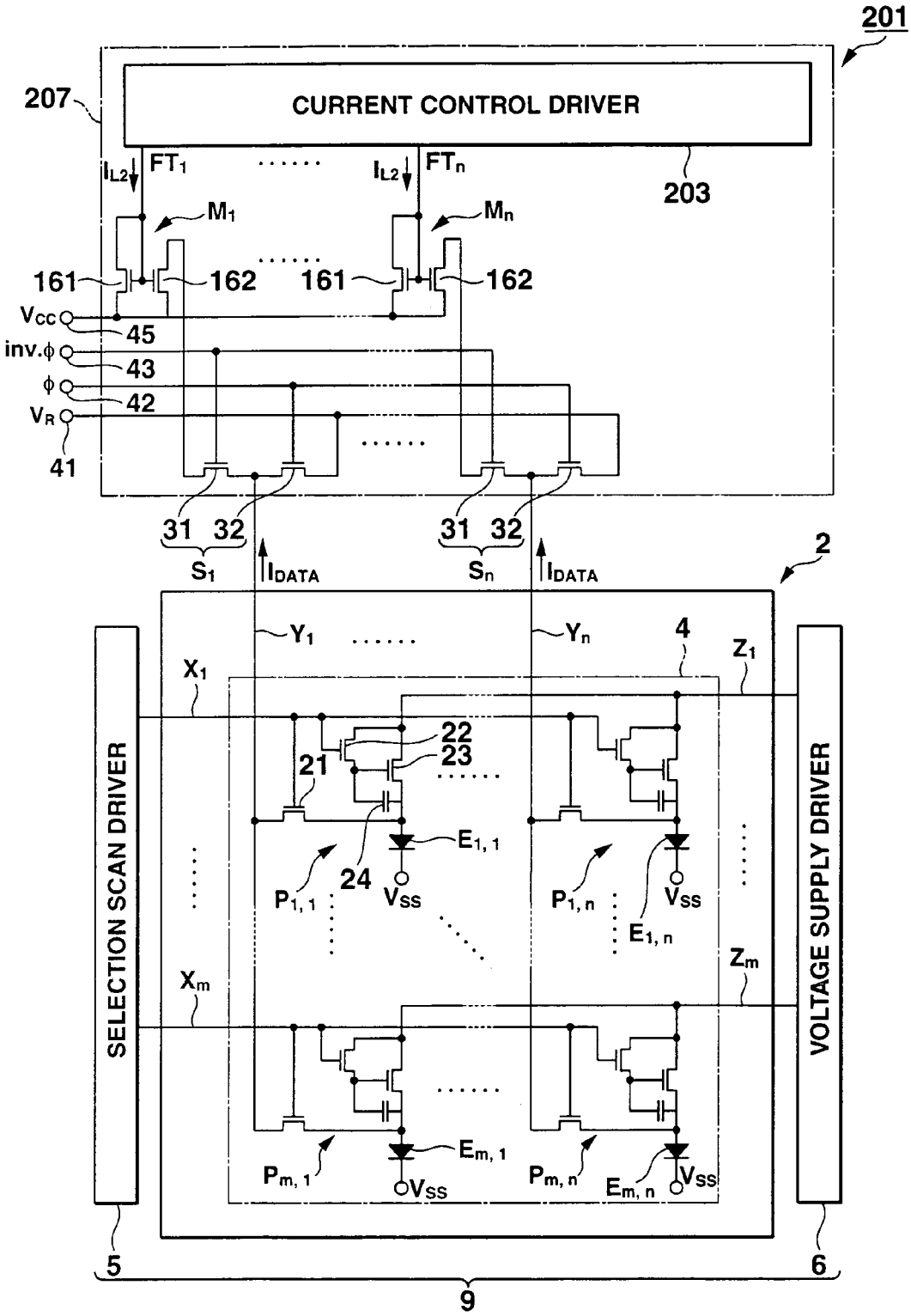
FIG. 11 is a block diagram of an organic electroluminescent display according to the third embodiment of the present invention.

FIG. 11 is a block diagram showing an organic EL display 201 according to the third embodiment to which the organic EL display of the present invention is applied. In FIG. 11, the same reference numerals and symbols as in the organic EL display 1 of the first embodiment denote the same parts in the organic EL display 201, and an explanation thereof will be omitted.

Similar to the organic EL display 1, the organic EL display 201 includes an organic EL display panel 2, scan driving circuit 9, and data driving circuit 207. The organic EL display panel 2 and scan driving circuit 9 are the same as the organic EL display panel 2 and scan driving circuit 9 of the first embodiment. The data driving circuit 207 is different from the data driving circuit 7 of the first embodiment.

The data driving circuit 207 includes a current control driver 203 which has n current terminals $FT_1$ to $FT_n$ and supplies a push current $I_{L2}$ to the current terminals $FT_1$ to $FT_n$, current mirror circuits $M_1$ to $M_n$ for converting the push current $I_{L2}$ flowing through the current terminals $FT_1$ to $FT_n$, and switches $S_1$ to $S_n$ interposed between current lines $Y_1$ to $Y_n$ and the current mirror circuits $M_1$ to $M_n$.

In the second embodiment, the current control driver 103 supplies the pull current $I_{L1}$ from the current mirror circuits $M_1$ to $M_n$ to the current terminals $DT_1$ to $DT_n$. In the third embodiment, the current control driver 203 supplies the push current $I_{L2}$ from the current terminals $FT_1$ to $FT_n$ to the current mirror circuits $M_1$ to $M_n$.

Each of the current mirror circuits $M_1$ to $M_n$ is made up of two N-channel MOS transistors 161 and 162. The transistors 161 and 162 can be fabricated by the same steps as transistors 21 to 23 of pixel circuits $D_{1,1}$ to $D_{m,n}$.

In each of the current mirror circuits $M_1$ to $M_n$, the gate and drain of the transistor 161 and the gate of the transistor 162 are connected together, and the sources of the transistors 161 and 162 are connected to a constant-voltage input terminal 45. A constant voltage $V_{CC}$ is applied to the constant-voltage input terminal 45. The level of the constant voltage $V_{CC}$ is lower than a tone designating current reference voltage $V_{LOW}$ and reference voltage $V_{SS}$. When the reference voltage $V_{SS}$ or tone designating current reference voltage $V_{LOW}$ is 0 [V] as in the first embodiment, the constant voltage $V_{CC}$ is a negative voltage.

An example of the switch $S_j$ will be explained below. The switch $S_j$ is made up of N-channel field-effect transistors 31 and 32. The gate of the transistor 31 is connected to a switching signal input terminal 43, and thus a switching signal inv.Φ is input to the gate of the transistor 31. Also, the gate of the transistor 32 is connected to a switching signal input terminal 42, and thus a switching signal Φ is input to the gate of the transistor 32. The drain of the transistor 31 is connected to the current line $Y_j$, and the source of the transistor 31 is connected to the drain of the transistor 162. The drain of the transistor 32 is connected to the current line $Y_j$. The source of the transistor 32 is connected to a reset input terminal 41, and thus a reset voltage $V_R$ as a constant voltage is applied to the source of the transistor 32. In this arrangement, when the switching signal Φ is at high level and the switching signal inv.Φ is at low level, the transistor 32 is turned on, and the transistor 31 is turned off. When the switching signal Φ is at low level and the switching signal inv.Φ is at high level, the transistor 31 is turned on, and the transistor 32 is turned off. The transistors 31 and 32 can be fabricated by the same steps as the transistors 21 to 23 of the pixel circuits $D_{1,1}$ to $D_{m,n}$. The reset voltage $V_R$ is preferably 0 [V] in order to completely discharge, e.g., the electric charges stored in the parasitic capacitances of the current lines $Y_1$ to $Y_n$ and the electric charges stored in the parasitic capacitances of pixel electrodes 51.

The current control driver 203 controls the current value of the push current $I_{L2}$ at the current terminals $FT_1$ to $FT_n$ in accordance with the image signal in each selection period $T_{SE}$ of each row, and holds the magnitude of the push current $I_{L2}$ constant in a period from the end of each reset period $T_R$ to the end of the corresponding selection period $T_{SE}$. The push current $I_{L2}$ supplied by the current control driver 203 is larger than and proportional to the tone designating current $I_{DATA}$ supplied by the current source driver 3 of the first embodiment.

The channel resistance of the transistor 161 is lower than that of the transistor 162. Therefore, the current mirror circuits $M_1$ to $M_n$ convert the push current $I_{L2}$ which flows through the current terminals $FT_1$ to $FT_n$ into a tone designating current $I_{DATA}$. The current value of the tone designating current $I_{DATA}$ is substantially a value obtained by multiplying the ratio of the cannel resistance of the transistor 161 to that of the transistor 162 by the current value of the push current $I_{L2}$ in the drain-to-source path of the transistor 161. Since the tone designating current $I_{DATA}$ flows through the output sides of the current mirror circuits $M_1$ to $M_n$, i.e., the drains of the transistors 162, these drains of the transistors 162 of the current mirror circuits $M_1$ to $M_n$ are equivalent to the current terminals $CT_1$ to $CT_n$ of the current source driver 3 of the first embodiment. That is, an arrangement obtained by combining the current mirror circuits $M_1$ to $M_n$ and current control driver 203 is equivalent to the current source driver 3 of the first embodiment.

The relationship between the timings of the switching signals Φ and inv.Φ and the selection timings of the selection scan driver 5 and voltage supply driver 6 in this embodiment is the same as in the first embodiment. Also, the operation timings of the selection scan driver 5 and voltage supply driver 6 in the third embodiment are the same as in the first embodiment. Therefore, in the reset period $T_R$ of the ith row, the first transistors 21 of the pixel circuits $D_{1,1}$ to $D_{m,n}$ are ON in the third embodiment as well. Accordingly, the voltages of the pixel electrodes 51 of organic EL elements $E_{i,1}$ to $E_{i,n}$, drains 21*d* of the first transistors 21 in the ith row, electrodes 24B of capacitors 24 in the ith row, sources 23*s* of the driving transistors 23 in the ith row, and the current lines $Y_1$ to $Y_n$ are set in a steady state, thereby removing the electric charges stored in these parasitic capacitances in the preceding selection period $T_{SE}$. Consequently, the tone designating current $I_{DATA}$ can be rapidly and accurately written in the next selection period $T_{SE}$.

The data driving circuit 207 applies the reset voltage $V_R$ to the current lines $Y_1$ to $Y_n$ in the selection period $T_{SE}$ in the third embodiment as well. Therefore, the first transistor 21 has both the function of a switching element which loads the reset voltage $V_R$ into each of the pixel circuits $D_{1,1}$ to $D_{m,n}$, and the function of a switching element which loads the tone designating current $I_{DATA}$ into each of the pixel circuits $D_{1,1}$ to $D_{m,n}$. Accordingly, the number of transistors necessary for the pixel circuits $D_{1,1}$ to $D_{m,n}$ does not increase. When the organic EL elements $E_{1,1}$ to $E_{m,n}$ are formed on the same surface as the pixel circuits $D_{1,1}$ to $D_{m,n}$, therefore, the aperture ratio of the pixels $P_{1,1}$ to $P_{m,n}$ does not decrease.

Fourth Embodiment

Figure 12:
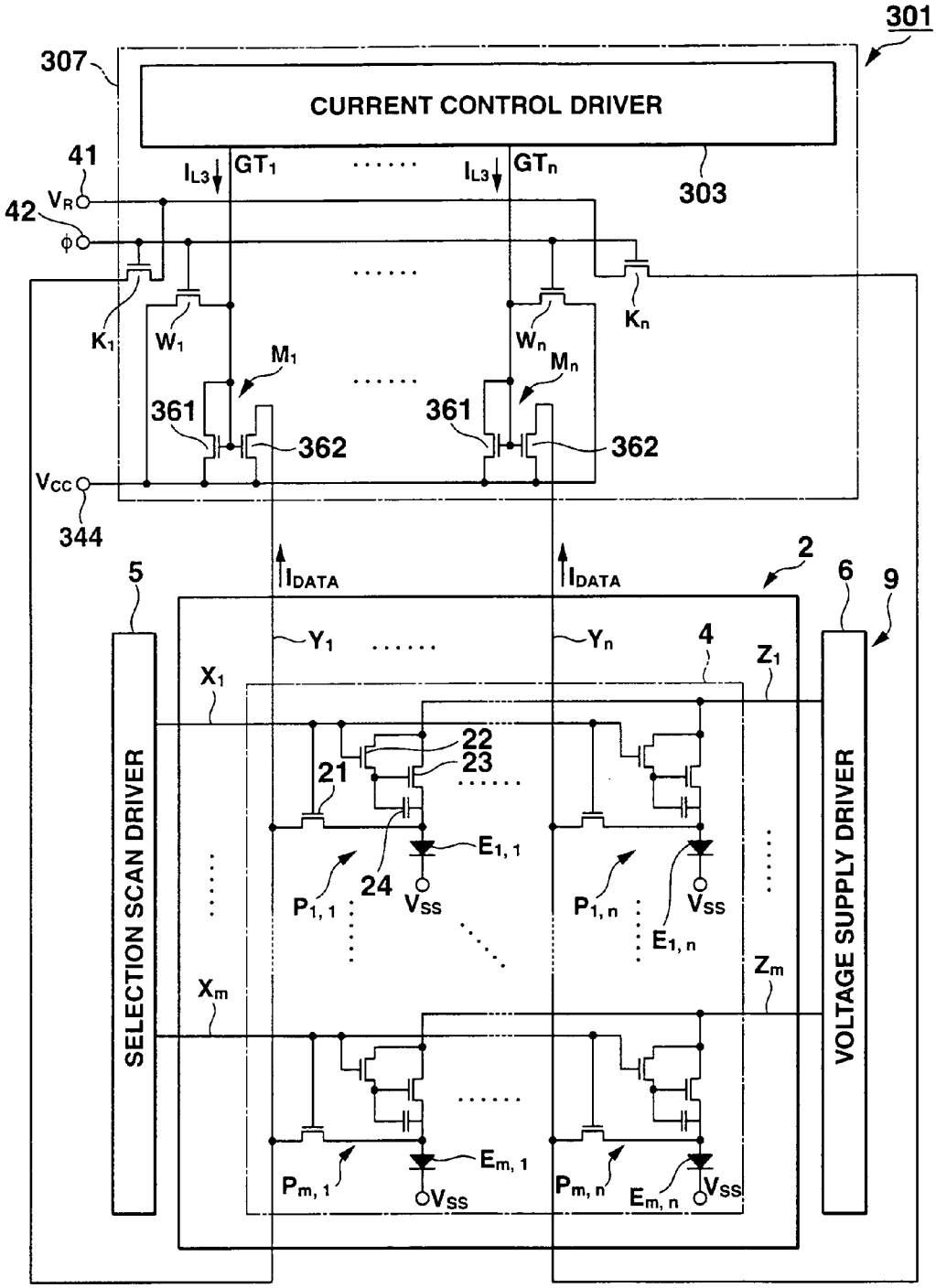
FIG. 12 is a block diagram of an organic electroluminescent display according to the fourth embodiment of the present invention.

FIG. 12 is a block diagram showing an organic EL display 301 according to the fourth embodiment to which the organic EL display of the present invention is applied. In FIG. 12, the same reference numerals and symbols as in the organic EL display 1 of the first embodiment denote the same parts in the organic EL display 301, and an explanation thereof will be omitted.

Similar to the organic EL display 1, the organic EL display 301 includes an organic EL display panel 2, scan driving circuit 9, and data driving circuit 307. The organic EL display panel 2 and scan driving circuit 9 are the same as the organic EL display panel 2 and scan driving circuit 9 of the third embodiment. The data driving circuit 307 is different from the data driving circuit 7 of the first embodiment.

The data driving circuit 307 includes a current control driver 303, current mirror circuits $M_1$ to $M_n$, switching elements $K_1$ to $K_n$, and switching elements $W_1$ to $W_n$ as switches.

The current control driver 303 has n current terminals $GT_1$ to $GT_n$. An 8-bit digital tone image signal is input to the current control driver 303. This digital tone image signal loaded into the current control driver 303 is converted into an analog signal by an internal D/A converter of the current control driver 303. The current control driver 303 generates a push current $I_{L3}$ having a current value corresponding to the analog image signal at the current terminals $GT_1$ to $GT_n$. The current control driver 303 controls the current value of the push current $I_{L3}$ at the current terminals $GT_1$ to $GT_n$ in each selection period $T_{SE}$ of each row in accordance with the image signal, and holds the current value of the push current $I_{L3}$ constant in a period from the end of each reset period $T_R$ to the end of the corresponding selection period $T_{SE}$. The push current $I_{L3}$ supplied by the current control driver 303 is larger than the tone designating current $I_{DATA}$ supplied by the current source driver 3 of the first embodiment, and proportional to a tone designating current $I_{DATA}$ which flows through a transistor 362 (to be described later).

The current mirror circuits $M_1$ to $M_1$ convert the push current $I_{L3}$ which flows through the current terminals $GT_1$ to $GT_n$ into the tone designating current $I_{DATA}$. Each of the current mirror circuits $M_1$ to $M_n$ has two transistors 361 and 362. In the current mirror circuit $M_j$, the gate of the transistor 361 is connected to the gate of the transistor 362, and the drain of the transistor 361 is connected to the current terminal and to the gates of the transistors 361 and 362. The drain of the transistor 362 is connected to a current line $Y_j$. The sources of the transistors 361 and 362 are connected to a common voltage terminal 344. A constant voltage $V_{CC}$ is applied to the voltage terminal 344. The level of the constant voltage $V_{CC}$ is lower than a tone designating current reference voltage $V_{LOW}$ and reference voltage $V_{SS}$. When the reference voltage $V_{SS}$ or tone designating current reference voltage $V_{LOW}$ is 0 [V] as in the first embodiment, the constant voltage $V_{CC}$ is a negative voltage.

The current value of the tone designating current $I_{DATA}$ is substantially a value obtained by multiplying the ratio of the cannel resistance of the transistor 362 to that of the transistor 361 by the current value of the push current $I_{L3}$ in the drain-to-source path of the transistor 361. That is, an arrangement obtained by combining the current mirror circuits $M_1$ to $M_n$ and current control driver 303 is equivalent to the current source driver.

The drains of the transistors or switching elements $W_1$ to $W_n$ are connected to the current terminals $GT_1$ to $GT_n$ and to the drains and gates of the transistors 361 of the current mirror circuits $M_1$ to $M_n$. The sources of the switching elements $W_1$ to $W_n$ are connected to the voltage terminal 344. The gates of the switching elements $W_1$ to $W_n$ are connected to a switching signal input terminal 42. The switching elements $W_1$ to $W_n$ switch the application of the constant voltage $V_{CC}$ to the drains of the transistors 361 of the current mirror circuits $M_1$ to $M_n$. Note that the switching elements $W_1$ to $W_n$ may also be incorporated into the current control driver 303.

The relationship between the timings of switching signals and the selection timings of a selection scan driver 5 and voltage supply driver 6 in this embodiment is the same as in the first embodiment.

In the reset period $T_R$ in the initial part of the selection period $T_{SE}$ of the ith row, therefore, the transistors $W_1$ to $W_n$ are turned on, so the voltages of the sources and drains of the transistors 361 become equal to each other. Accordingly, after the reset period $T_R$ of the selection period $T_{SE}$, the influence of the parasitic capacitances of the current mirror circuits $M_1$ to $M_n$ on the current lines $Y_1$ to $Y_n$ can be removed.

In each of switching elements $K_1$ to $K_n$, one of the drain and source is connected to a reset input terminal 41, the other of the drain and source is connected to a corresponding one of the current lines $Y_1$ to $Y_n$, and the gate is connected to the switching signal input terminal 42. The switching elements $K_1$ to $K_n$ switch the application of the reset voltage $V_R$ to the current lines $Y_1$ to $Y_n$. The reset voltage $V_R$ is set at 0 [V]. Note that on the opposite side of the connecting portion between each of the current lines $Y_1$ to $Y_n$ and the transistor 362, the other of the drain and source of a corresponding one of the switching elements $K_1$ to $K_n$ may also be connected to a corresponding one of the current lines $Y_1$ to $Y_n$, and the switching elements $K_1$ to $K_n$ may also be formed on the organic EL display panel 2.

In the reset period $T_R$ in the initial part of the selection period $T_{SE}$ of the ith row, the switching elements $K_1$ to $K_n$ are turned on, so pixel electrodes 51 and the current lines $Y_1$ to $Y_n$ electrically conduct to the reset input terminal 41 to apply the grounded reset voltage $V_R$. Therefore, immediately after the start of the reset period $T_R$ of the ith row, it is possible to remove the electric charges stored in the parasitic capacitances of the current lines $Y_1$ to $Y_n$, the electric charges stored in the parasitic capacitances of the pixel electrodes 51, the electric charges stored in the parasitic capacitances of electrodes 24B of capacitors 24, and the electric charges stored in the parasitic capacitances of the sources of driving transistors 23. Accordingly, the tone designating current $I_{DATA}$ having a very small current value can be accurately and rapidly supplied. After the reset period $T_R$, the switching elements $K_1$ to $K_n$ and $W_1$ to $W_n$ are turned off, and an electric current having a current value corresponding to the tone flows through the current terminals $GT_1$ to $GT_n$ of the current control driver 303. Consequently, the tone designating current $I_{DATA}$ modulated by the current mirror circuits $M_1$ to $M_n$ flow through the current lines $Y_1$ to $Y_n$ and driving transistor 23.

The data driving circuit 307 applies the reset voltage $V_R$ to the current lines $Y_1$ to $Y_n$ in the selection period $T_{SE}$ in the fourth embodiment as well. Therefore, a first transistor 21 has both the function of a switching element which loads the reset voltage $V_R$ into each of the pixel circuits $D_{1,1}$ to $D_{m,n}$, and the function of a switching element which loads the tone designating current $I_{DATA}$ into each of the pixel circuits $D_{1,1}$ to $D_{m,n}$. Accordingly, the number of transistors necessary for the pixel circuits $D_{1,1}$ to $D_{m,n}$ does not increase. When organic EL elements $E_{1,1}$ to $E_{m,n}$ are formed on the same surface as the pixel circuits $D_{1,1}$ to $D_{m,n}$, therefore, the aperture ratio of the pixels $P_{1,1}$ to $P_{m,n}$ does not decrease.

The present invention is not limited to the above embodiments, and various improvements and design changes can be made without departing from the spirit and scope of the present invention.

For example, an organic EL element is used as a light-emitting element in each of the above embodiments. However, another light-emitting element having rectification characteristics may also be used. That is, it is also possible to use a light-emitting element in which no electric current flows if a reverse bias voltage is applied and an electric current flows if a forward bias voltage is applied, and which emits light at luminance corresponding to the current value of the flowing electric current. An example of the light-emitting element having rectification characteristics is an LED (Light-Emitting Diode).

In addition, the tone designating current reference voltage $V_{LOW}$ of the voltage supply driver 6 may also be positioned on the right side of the EL load border line corresponding to the maximum luminance tone shown in FIG. 4, provided that a portion or the whole of the tone designating current $I_{DATA}$ does not flow through the organic EL elements in the selection period $T_{SE}$.

What is claimed is:

1. A display device comprising:

a plurality of selection scan lines;

a plurality of current lines;

a selection scan driver which sequentially selects said plurality of selection scan lines in each selection period;

a data driving circuit which applies a reset voltage to said plurality of current lines in a first part of the selection period, and supplies a designating current having a current value corresponding to an image signal to said plurality of current lines in a second part of the selection period after applying the reset voltage in the selection period; and a plurality of pixel circuits which are connected to said plurality of selection scan lines and said plurality of current lines, and supply a driving current having a current value corresponding to the current value of the designating current which flows through said plurality of current lines;

wherein in the selection period, each of said plurality of pixel circuits loads the designating current which flows through said plurality of current lines, and stores a level of a voltage converted in accordance with the current value of the designating current, and after the selection period, each of said plurality of pixel circuits shuts off the designating current which flows through said plurality of current lines, and supplies a driving current corresponding to the level of the voltage converted in accordance with the designating current.

2. An apparatus according to claim 1, wherein said data driving circuit comprises:

a switch which switches to a state in which the reset voltage is applied to said plurality of current lines in the first part of the selection period; and a current source driver which supplies the designating current having the current value corresponding to the image signal after the reset voltage is applied by the switch within the selection period.

3. An apparatus according to claim 1, further comprising a plurality of light-emitting elements which are arranged at intersections of said plurality of selection scan lines and said plurality of current lines, emit light at luminance corresponding to a current value of a driving current, and each have two electrodes one of which is connected to a corresponding one of said plurality of pixel circuits.

4. An apparatus according to claim 3, wherein the reset voltage applied by the data driving circuit is set equal to or lower than a voltage of the other electrode of the light-emitting element.

5. An apparatus according to claim 1, further comprising:

a plurality of voltage supply lines; and a voltage supply driver which sequentially selects said plurality of voltage supply lines in synchronism with the sequential selection of said plurality of selection scan lines by the selection scan driver.

6. An apparatus according to claim 5, wherein each of said pixel circuits comprises:

a first transistor having a gate connected to the selection scan line, and a drain and source one of which is connected to the current line;

a second transistor having a gate connected to the selection scan line, and a drain and source one of which is connected to the voltage supply line;

a driving transistor having a gate connected to the other of the drain and source of the second transistor, and a drain and source one of which is connected to the voltage supply line, and the other of which is connected to the other of the drain and source of the first transistor; and a capacitor which stores a gate-to-one of source and drain voltage of the driving transistor by holding the voltage.

7. An apparatus according to claim 6, which further comprises a plurality of light-emitting elements which are arranged at intersections of said plurality of selection scan lines and said plurality of current lines, emit light at luminance corresponding to a current value of a driving current, and each have two electrodes one of which is connected to a corresponding one of said plurality pixel circuits, and in which the other electrode of the light-emitting element is connected to the other of the drain and source of the driving transistor.

8. An apparatus according to claim 7, wherein in the selection period, the first transistor supplies the designating current from the voltage supply line to the current line via the drain-to-source path of the driving transistor, the driving transistor converts the current value of the designating current into a level of a gate-to-one of source and drain voltage, and the capacitor stores the level of the converted voltage, and after the selection period, the driving transistor supplies, to the light-emitting element, a driving current having a current value corresponding to the level of the gate-to-one of source and drain voltage stored by the capacitor.

9. An apparatus according to claim 7, wherein the voltage applied to the voltage supply line by the voltage supply driver in the selection period is set not higher than a voltage of the other electrode of the light-emitting element, and the voltage applied to the voltage supply line by the voltage supply driver after the selection period is set higher than the voltage of the other electrode of the light-emitting element.

10. A display device comprising:

a plurality of selection scan lines;

a plurality of current lines;

a plurality of light-emitting elements which are arranged at intersections of said plurality of selection scan lines and said plurality of current lines, and emit light at luminance corresponding to a current value of a driving current;

a selection scan driver which sequentially selects said plurality of selection scan lines in each selection period;

a data driving circuit which applies a reset voltage to said plurality of current lines in a first part of the selection period, and supplies a designating current having a current value corresponding to an image signal to said plurality of current lines in a second part of the selection period after applying the reset voltage in the selection period; and a plurality of pixel circuits which are connected to said plurality of selection scan lines and said plurality of current lines, and electrically connect said plurality of current lines and said plurality of light-emitting elements to each other in the selection period;

wherein in the selection period, each of said plurality of pixel circuits loads the designating current which flows through said plurality of current lines, and stores a level of a voltage converted in accordance with the current value of the designating current, and after the selection period, each of said plurality of pixel circuits shuts off the designating current which flows through said plurality of current lines, and supplies a driving current corresponding to the level of the voltage converted in accordance with the designating current.

11. A display panel driving method comprising:

sequentially selecting a plurality of selection scan lines of a display panel comprising a plurality of pixel circuits connected to the plurality of selection scan lines and a plurality of current lines, and a plurality of light-emitting elements which are arranged at intersections of the plurality of selection scan lines and the plurality of current lines, wherein each of the light-emitting elements emits light at luminance corresponding to a current value of a current flowing the current line;

applying a reset voltage to the plurality of current lines in an initial part of a period in which each of the plurality of selection scan lines is selected;

after applying the reset voltage, supplying designating currents having current value corresponding to an image signal to the plurality of current lines, and storing, in the plurality of pixel circuits, the current value of the designating currents flowing through the plurality of current lines; and after supplying the designating currents, allowing the plurality of pixel circuits to supply, to the plurality of light-emitting elements, driving currents having current value corresponding to the stored current value of the designating currents.

* * * * *